US005288579A

United States Patent [19]

Tanaka et al.

[11] Patent Number: 5,288,579

[45] Date of Patent: Feb. 22, 1994

[54] DEVELOPER FOR DEVELOPING ELECTROSTATIC IMAGE, IMAGE FORMING APPARATUS, APPARATUS UNIT AND FACSIMILE APPARATUS

[75] Inventors: Katsuhiko Tanaka; Kazuyoshi Hagiwara; Tsuyoshi Takiguchi, all of Yokohama; Rika Doi, Tokyo, all of Japan

[73] Assignee: Canon Kabushiki Kaisha, Tokyo, Japan

[21] Appl. No.: 801,486

[22] Filed: Dec. 2, 1991

[30] Foreign Application Priority Data

Nov. 30, 1990 [JP] Japan ..... 2-33095
May 20, 1991 [JP] Japan ..... 3-142763

[51] Int. Cl.[5] ..... G03G 9/00; G03G 9/083; G03G 9/107

[52] U.S. Cl. ..... 430/110; 430/106; 430/106.6

[58] Field of Search ..... 430/106, 106.6, 109, 430/110, 137

[56] References Cited

U.S. PATENT DOCUMENTS 2,297,691 10/1942 Carlson ..... 95/5
4,636,451 1/1987 Matkin et al. ..... 430/109
4,663,263 5/1987 Ikeda et al. ..... 430/110

FOREIGN PATENT DOCUMENTS 42-23910 11/1967 Japan .
43-24748 10/1968 Japan .

OTHER PUBLICATIONS

Patent Abstract of Japan, vol. 10, No. 290 (P-503) [2346], Oct. 2, 1986 for JPA 61-110157, published May 28, 1986.

Patent Abstracts of Japan, vol. 12, No. 203, (P-715) [3050], Jun. 11, 1988 for JPA 63-5357, published Jan. 11, 1988.

*Primary Examiner*—Marion E. McCamish
*Assistant Examiner*—Stephen C. Crossan
*Attorney, Agent, or Firm*—Fitzpatrick, Cella, Harper & Scinto

[57] ABSTRACT

A developer for developing electrostatic images is constituted by toner containing a binder resin and a charge controller. The charge controller comprises an arylurea compound which is an arylurea having at least one electron-attracting group or electron-donating group, or a polyarylurea including such an arylurea as a recurring unit. The arylurea compound is substantially colorless and can have stable but different levels of triboelectric chargeability depending on the substituents.

77 Claims, 7 Drawing Sheets

DEVELOPER FOR DEVELOPING ELECTROSTATIC IMAGE, IMAGE FORMING APPARATUS, APPARATUS UNIT AND FACSIMILE APPARATUS

FIELD OF THE INVENTION AND RELATED ARTS

The present invention relates to a developer for visualizing electrostatic images in image forming methods, such as electrophotography, electrostatic recording and electrostatic printing, and an image forming apparatus, an apparatus unit and a facsimile apparatus using the developer.

Hitherto, a large number of electrophotographic processes have been described, e.g., in U.S. Pat. No. 2,297,691, Japanese Patent Publication (JP-B) 42-23910 and JP-B 43-24748.

Developing methods used in such electrophotographic processes may be roughly classified into the dry developing method and the wet developing method. The former is further classified into the method using a two-component type developer and a mono-component type developer.

The developer used in the dry developing method comprises a toner which has conventionally comprised fine powder in which a dye or pigment is dispersed in a natural or synthetic resin. For example, a colorant is dispersed in a binder resin such as polystyrene, and particles obtained by micropulverizing the resultant dispersion into sizes of about 1–30 microns are used as the toner. A magnetic toner has been prepared by dispersing magnetic particles in a binder resin. In case of the system employing the two-component type developer, a toner is used generally in mixture with carrier particles, such as glass beads or iron powder.

In any case, the toner is required to have a positive or negative charge depending on the polarity of an electrostatic latent image to be developed.

In order to provide a toner with a charge, it is possible to utilize the triboelectric chargeability of a resin constituting the toner. This method however generally provides only a low charge so that the resultant image after development is liable to be accompanied with fog and unclear. It has been practiced to add a dye or pigment having a chargeability-imparting ability or a charge controller.

The charge controllers known in the art at present may include: metal complex salts of monoazo dyes, metal complex salts of salicylic acid, naphthoic acid and dicarboxylic acids, and copper phthalocyanine pigment.

Among these charge controllers, some are liable to soil a toner-carrying member such as a sleeve or a carrier and therefore a toner using such a charge controller causes a lowering in triboelectric charge leading to an image density decrease as the number of copied sheets is increased. Further, some charge controllers provide only an insufficient triboelectric chargeability which is liable to be affected by changes in temperature and humidity, thus resulting in lower image density according to environmental changes Some charge controllers have a poor storage stability and cause a lowering in triboelectric chargeability during a long term of storage. Some charge controllers have a poor dispersibility in a resin, so that a toner using the controller is liable to be accompanied with nonuniform triboelectric charges among particles and with fog. Some charge controllers have poor thermal stability and can decompose or denaturate, and a toner prepared by re-use of a toner using such a controller is liable to produce reversely charged particles resulting in fog. Some charge controllers are colored and therefore cannot be used in a color toner.

For the above reasons, it is still desired to develop a charge controller having further improved properties.

SUMMARY OF THE INVENTION

A generic object of the present invention is to provide a developer for developing electrostatic images having solved the above-mentioned problems.

A more specific object of the present invention is to provide a developer which does not easily soil a developer-carrying member, such as a sleeve or a carrier and does not cause a lowering in triboelectric charge on copying of an increased number of sheets, thus providing a stable image density.

Another object of the present invention is to provide a developer excellent in triboelectric chargeability which is little affected by changes in temperature and humidity.

An object of the present invention is to provide a developer having a good storage stability and a triboelectric chargeability which is free from or accompanied with only little change during long term storage.

An object of the present invention is to provide a developer wherein toner particles containing a charge controller uniformly dispersed within a resin are provided with a uniform triboelectric charge to provide the developer with little tendency of providing fogged images.

An object of the present invention is to provide a developer which contains a charge controller having a good thermal stability and free from decomposition or denaturation during a hot kneading step for toner production, can be recycled and is hardly susceptible to fogging.

An object of the present invention is to provide a developer comprising a color toner containing a colorless or light-colored charge controller.

A further object of the present invention is to provide an image forming apparatus, an apparatus unit and a facsimile apparatus using such a developer as described above.

According to the present invention, there is provided a developer for developing electrostatic images, comprising: a toner containing a binder resin and a charge controller, said charge controller comprising an arylurea compound which comprises an arylurea having at least one electron-attracting group or electron-donating group, or a polyarylurea including such an arylurea as a recurring unit.

According to another aspect of the present invention, there is provided an image forming apparatus, comprising:

an image-bearing for bearing an electrostatic latent image;

charging means for charging the image-bearing member, latent image-forming means for forming a latent image on the charged image bearing member, developing means for developing the electrostatic latent image to form a toner image on the image-bearing member, transfer means for transferring the toner image from the image-bearing member to a transfer-receiving material, cleaning means for removing a portion of the toner remaining on the image-bearing member, fixing means for fixing the transferred toner image on the transfer-receiving material under action of heat and pressure;

wherein said developing means retains a developer comprising a toner containing a binder resin and a charge controller, said charge controller comprising an arylurea compound which comprises an arylurea having at least one electron-attracting group or electron-donating group, or a polyarylurea including such an arylurea as a recurring unit.

According to another aspect of the present invention, there is provided an apparatus unit which is to be incorporated so as to form the image forming apparatus described above and comprises the developing means supported integrally together with at least one of the image-bearing member, charging means and cleaning means, so that the apparatus can be arbitrarily connected to or released from an apparatus body including at least the latent image forming means, the transfer means and the fixing means.

According a still further aspect of the present invention, there is provided a facsimile apparatus comprising the above-mentioned image forming apparatus as a printer, and receiving means for receiving image data from a remote terminal.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
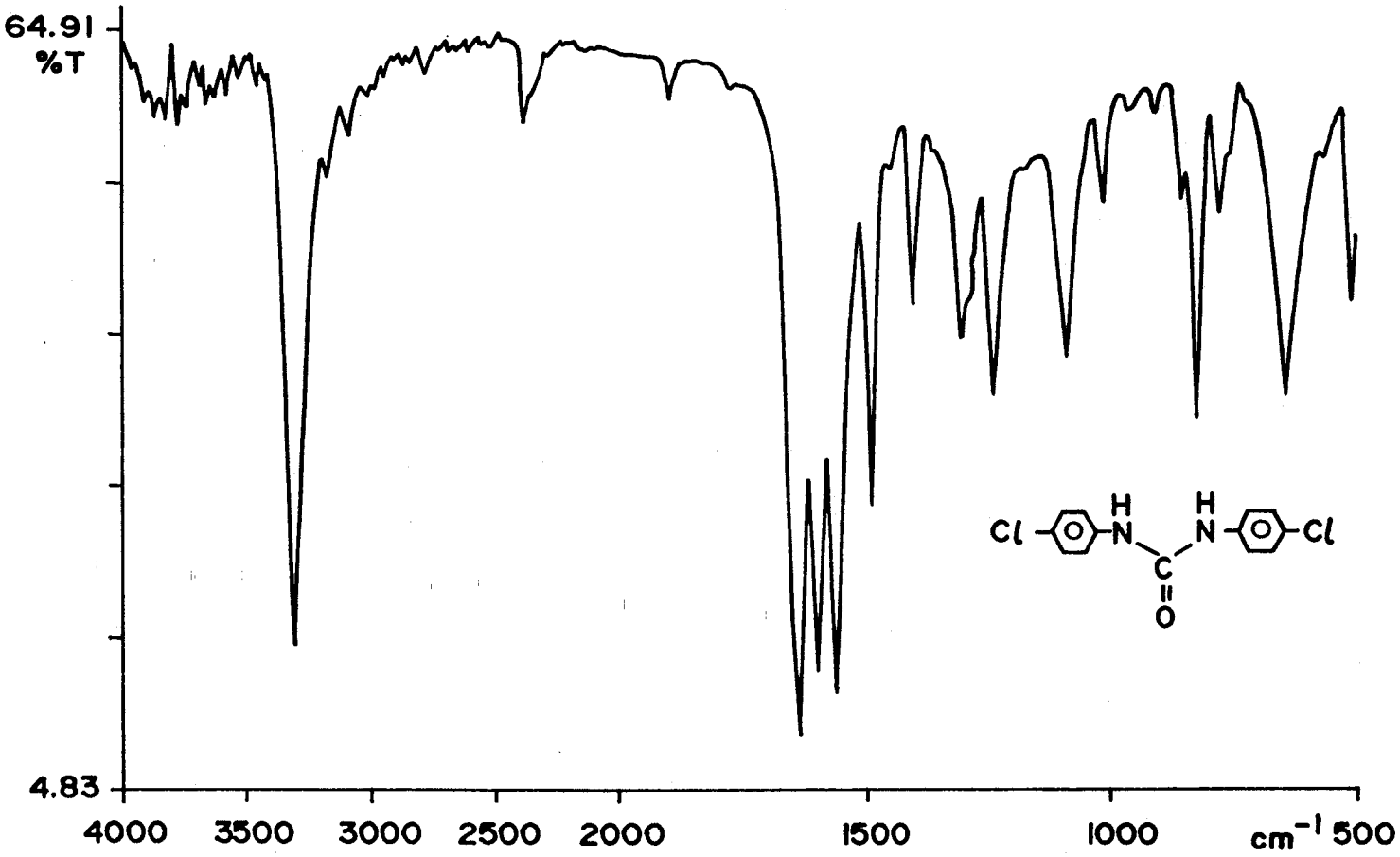
FIG. 1 is an FTIR chart of an urea derivative of compound Example 1.

As a result of our study, it has been discovered that an arylurea compound comprising an arylurea having at least one electron-attracting group or electron-donating group or a polyarylurea including such an arylurea as a recurring unit is substantially colorless and, when contained in a toner, provides the toner with a sufficient triboelectric chargeability, thus providing a solution to the above-mentioned problems. The present invention is based on the discovery.

It has not been known to use a urea derivative as a charge controller, but an analogous compound, thiourea derivative, has been proposed as a charge controller (Japanese Laid-Open Patent Application (JP-A 61-110157). We have examined the triboelectric chargeability of such thiourea derivatives and found that the thiourea derivatives show a negative triboelectric chargeability which however is insufficient. Further, thiourea derivatives show triboelectric chargeabilities which vary little depending on substitutions introduced thereto, and thus it is difficult to obtain a toner having a desired level of triboelectric chargeability.

As a result of our further study for charge controllers having a sufficient triboelectric chargeability and capable of changing triboelectric chargeabilities varying depending on substituents introduced thereto, we have found a class of urea derivatives. Most urea derivatives are colorless or only lightly colored, even if colored, thus being inclusively regarded as substantially colorless, so that they are optimum as charge controllers for color toners. Urea derivatives are thermally and mechanically stable and do not decompose when stirred in a developing apparatus. Therefore, a color toner obtained by using a urea derivative can always provide clear images regardless of an increased number of copying cycles. Thus, the present invention has been accomplished based on a discovery that a toner containing a class of the urea derivatives according to the present invention is provided with better properties than a toner containing a conventional charge controller.

The arylurea compound used as the charge controller according to the present invention comprises an arylurea having at least one electron-attracting group or electron-donating group or a polyarylurea including such an arylurea as a recurring unit.

The arylurea compound according to the present invention may preferably be an N,N'-bisarylurea derivative represented by the following formula (I) in view of facility of synthesis:

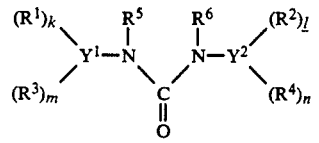

(I)

wherein $Y^1$ and $Y^2$ denote a phenyl or naphthyl group; $R^1$ and $R^2$ independently denote a halogen atom, nitro group, sulfonic acid group, carboxyl group, carboxylic acid ester group, cyano group or carbonyl group; $R^3$ and $R^4$ denote a hydrogen atom, alkyl group, alkoxy group, phenyl group capable of having a substituent, or aralkyl group capable of having a substituent; $R^5$ and $R^6$ denote a hydrogen atom or $C_1$–$C_8$ hydrocarbon group; k and l are 0, 1 or 2 satisfying $k+l \geqq 1$; and m and n are 1 or 2. Examples of the substituent attachable to the phenyl group and aralkyl group may include: halogen atom, nitro group, sulfonic acid group, carboxyl group, carboxylic acid group, cyano group and carbonyl group; of which halogen atom, carboxyl group and carboxylic acid ester group are particularly preferred.

Hereinbelow, some representative examples of the arylurea compound having at least one electron-attracting group preferred in view of, e.g., facility of handling are enumerated hereinbelow, but they are not exhaustive:

Compound Example
(1)
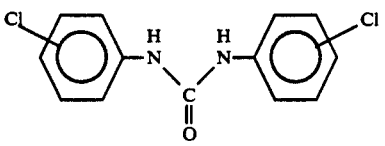
(2)
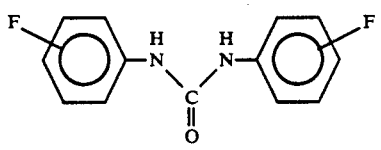
(3)
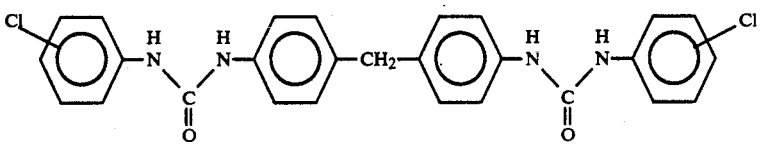
(4)
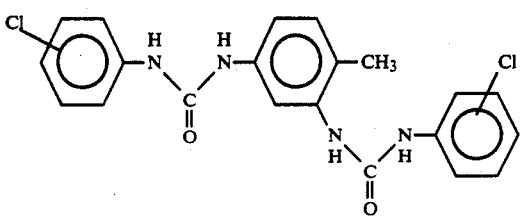
(5)
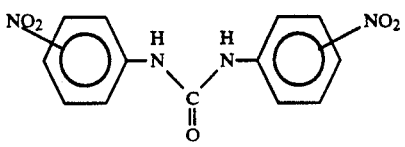
(6)
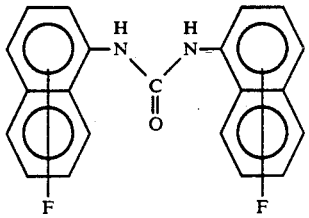
(7)
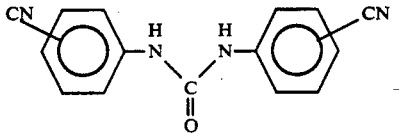
(8)
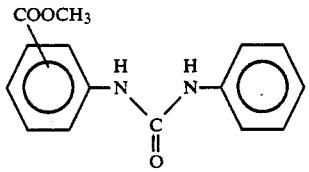
(9)
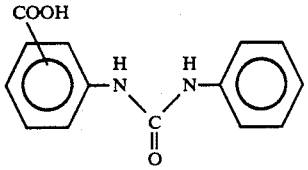
(10)
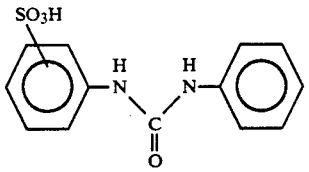
(11)
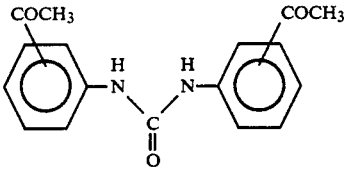
(12)
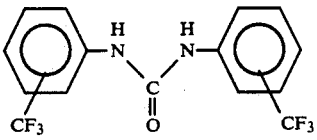
(13)
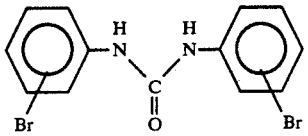
(14)
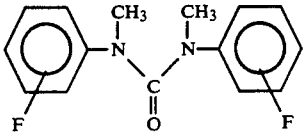
(15)
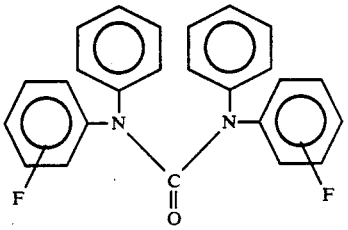

-continued

Compound Example (16)

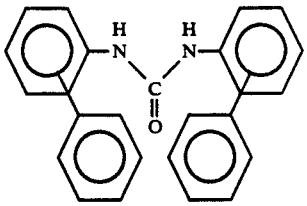

(17)

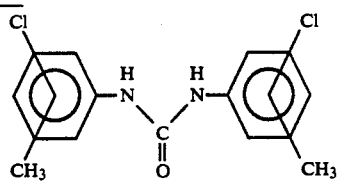

(18)

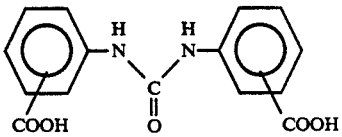

(19)

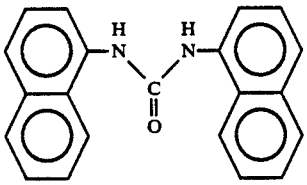

(20)

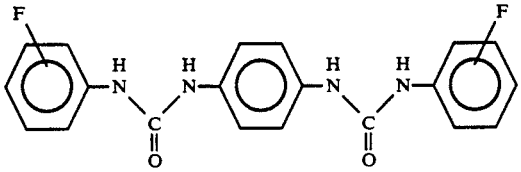

Another class of the arylurea compound according to the present invention preferred in view of facility of handling may include an N,N'-bisarylurea derivative represented by the following formula (II):

(II)

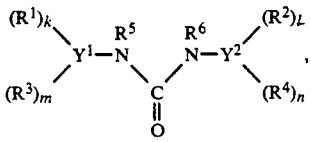

wherein $Y^1$ and $Y^2$ denote a phenyl group, naphthyl group or anthryl group; $R^1$ and $R^2$ independently denote an alkyl group, alkoxy group or amino group; $R^3$ and $R^4$ denote a hydrogen atom, alkyl group, alkoxy group, amino group, phenyl group capable of having a substituent, or aralkyl group capable of having a substituent; $R^5$ and $R^6$ are a hydrogen atom or $C_1$–$C_8$ hydrocarbon group; k and l are 0, 1 or 2 satisfying $k+l \geqq 1$; and m and n are 1 or 2. Examples of the substituent attachable to the phenyl group or aralkyl group may include: alkyl group, alkoxy group and amino group, of which alkyl group is particularly preferred.

Hereinbelow, some representative examples of the arylurea compound having at least one electron-donative group preferred in view of, e.g., facility of handling are enumerated hereinbelow, but they are not exhaustive:

Compound Example (21)

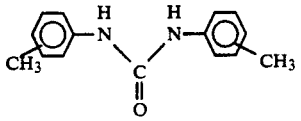

(22)

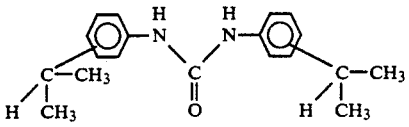

-continued

Compound Example (23)

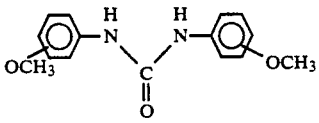

(24)

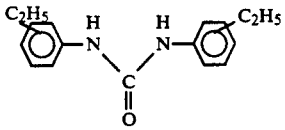

(25)

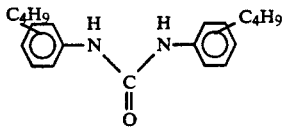

(26)

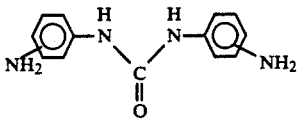

(27)

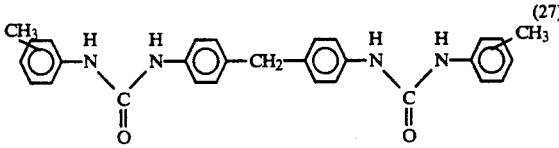

(28)

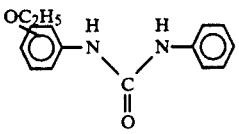

-continued

Compound Example (29)

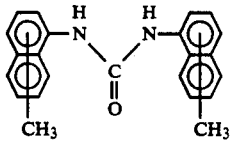

(30)

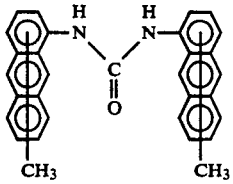

(31)

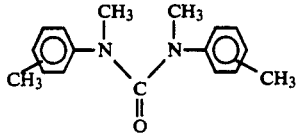

(32)

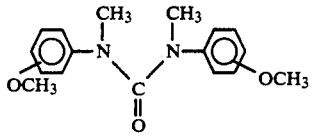

The urea derivative according to the present invention may be synthesized according to an ordinary method, e.g., by reacting an aniline derivative and an isocyanate derivative in benzene as solvent. As a specific example, a parachloro-substituted form of Compound Example (1) was synthesized in the following manner.

372.7 g of 4-chloroaniline and 2.5 liter of benzene were charged in a 4-necked flask, and a solution of 448.7 g of 4-chlorophenyl isocyanate was added dropwise thereto in 40 minutes. At the time of the dropwise addition, heat was evolved to raise the temperature up to 55° C. After the addition, the system was heated under a reflux condition (81° C.) for 1.5 hours of reaction. After cooling, the product was recovered by filtration, washed with methanol until the filtrate became clear, and dried for 42 hours by a hot-air drier at 50° C. to obtain 805 g of grayish white powder.

Figure 2:
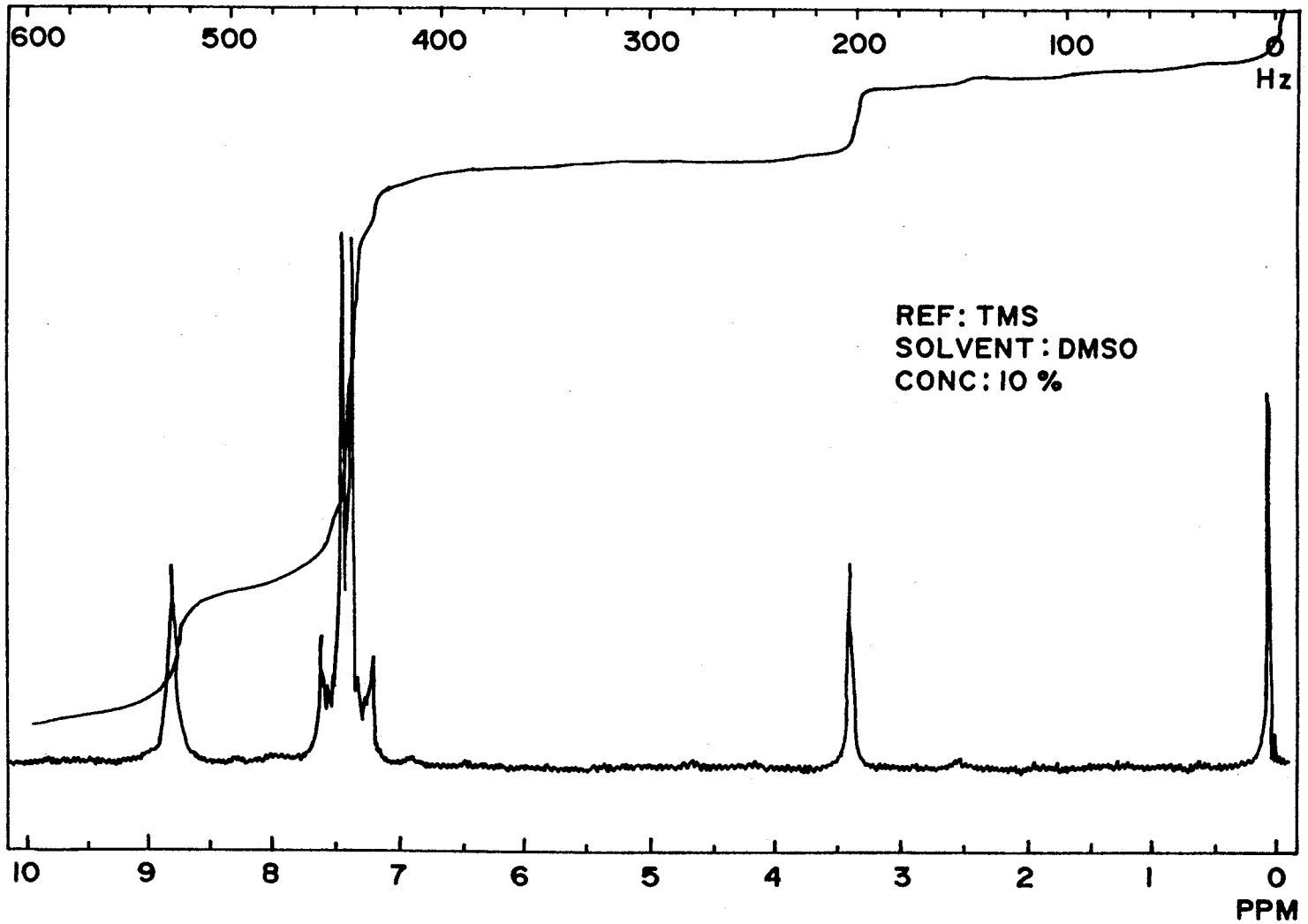
FIG. 2 is an $^1$H-NMR chart of an urea derivative of Compound Example 1.

The product was identified by FTIR (Fourier transform infrared spectroscopy) using an infrared spectrophotometer ("Model 270-30", available from Hitachi Seisakusho K.K.) and $^1$H-NMR (nuclear magnetic resonance) using a nuclear magnetic resonance apparatus ("Model R-24B", available from Hitachi Seisakusho K.K.) to obtain charts shown in FIGS. 1 and 2, respectively.

A para-methoxy-substituted form of Compound Example (23) was synthesized in the following manner.

Figure 3:
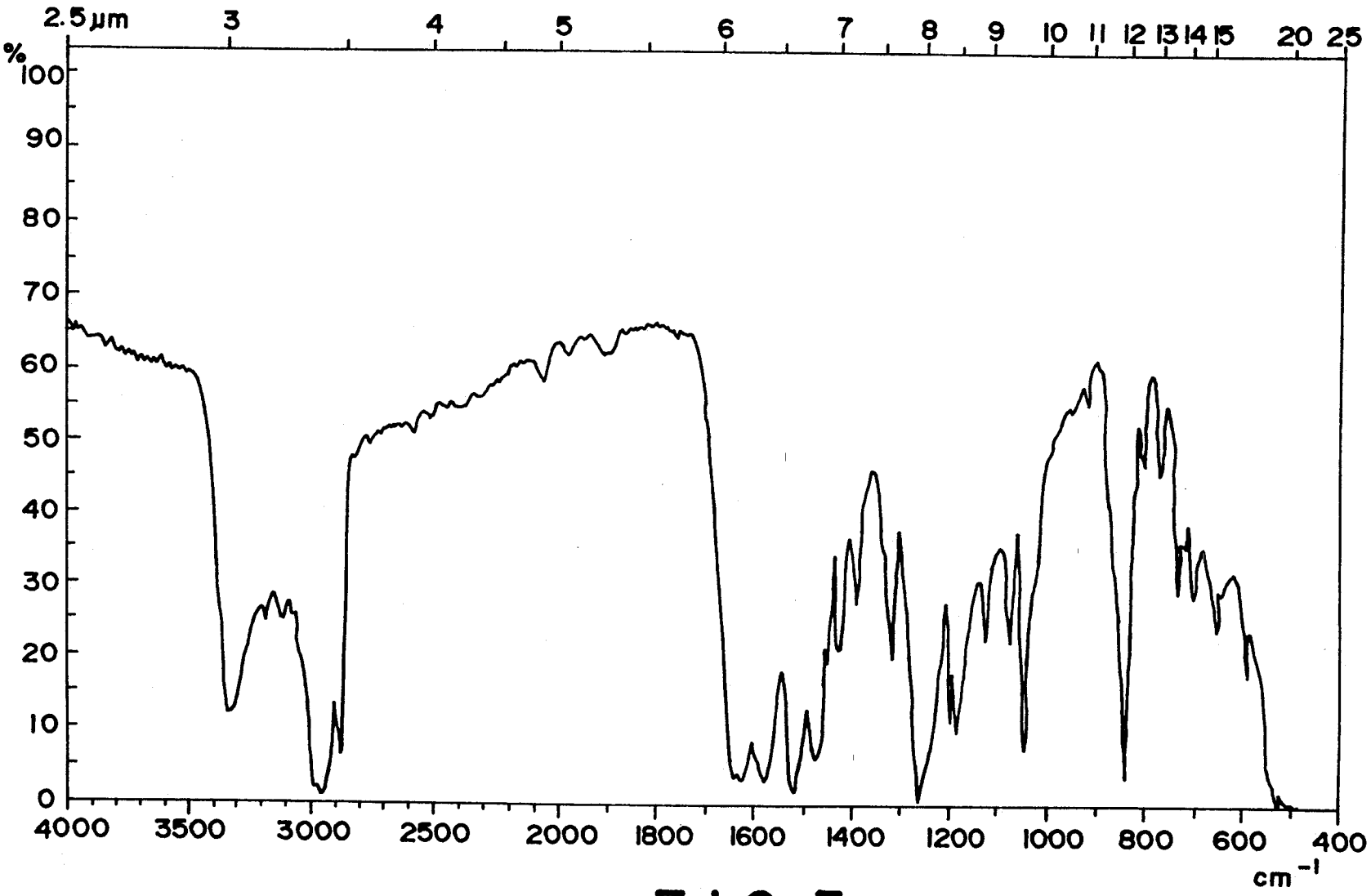
FIG. 3 is an FTIR chart of an urea derivative of Compound Example 21.
Figure 4:
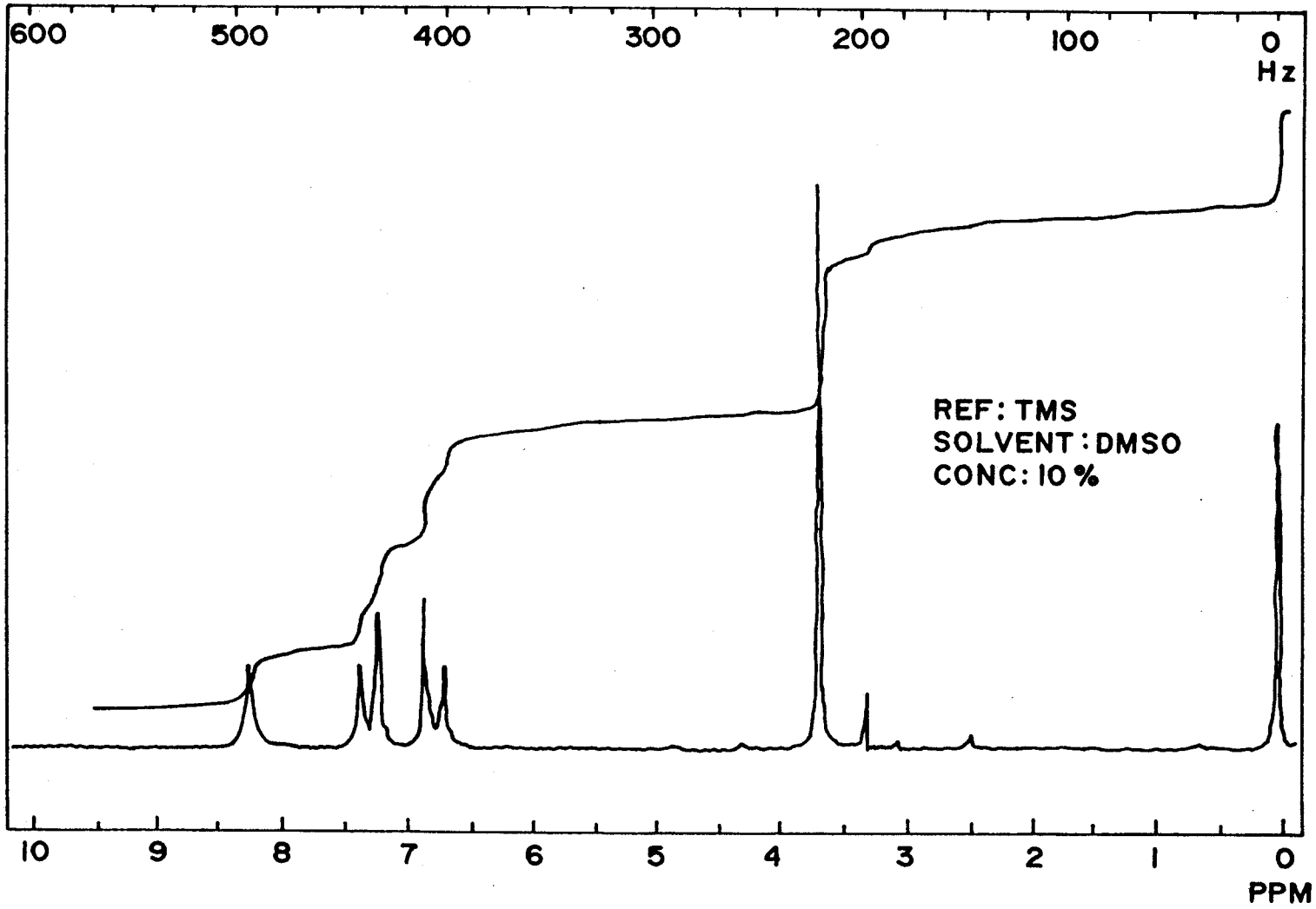
FIG. 4 is an $^1$H-NMR chart of an urea derivative of Compound Example 21.

320 g of 4-methoxy aniline and 2.5 liter of benzene were charged in a 4-necked flask, and a solution of 395 g of 4-methoxyphenyl isocyanate in 0.5 liter of benzene was added dropwise thereto in 40 minutes. After the addition, the system was heated under a reflux condition (81° C.) for 1.5 hours. After cooling, the product was recovered by filtration, washed with methanol until the filtrate became clear, and dried for 24 hours by a hot-air drier to obtain 695 g of grayish white powder. The product was identified by FTIR and $^1$H-NMR to obtain respective charts shown in FIGS. 3 and 4.

A paramethyl-substituted form a Compound Example (21) was synthesized identified in substantially the same manner as above from 4-methylaniline and 4-methylphenyl isocyanate.

The urea derivative according to the present invention may be added to a toner internally or externally. The amount of addition cannot be determined in a unitary way but may depend on several factors of toner production, such as the kind of the binder resin, the presence or absence of optional additives and methods of addition of such additives. In case of internal addition, however, it is preferred to use 0.1–10 wt. parts, more preferably 0.1–5 wt. parts of the urea derivative per 100 wt. parts of the binder resin. In case of external addition, it is preferred to use 0.01–10 wt. parts, more preferably 0.05–1 wt. part, of the urea derivative per 100 wt. parts of the binder resin.

Figure 5:
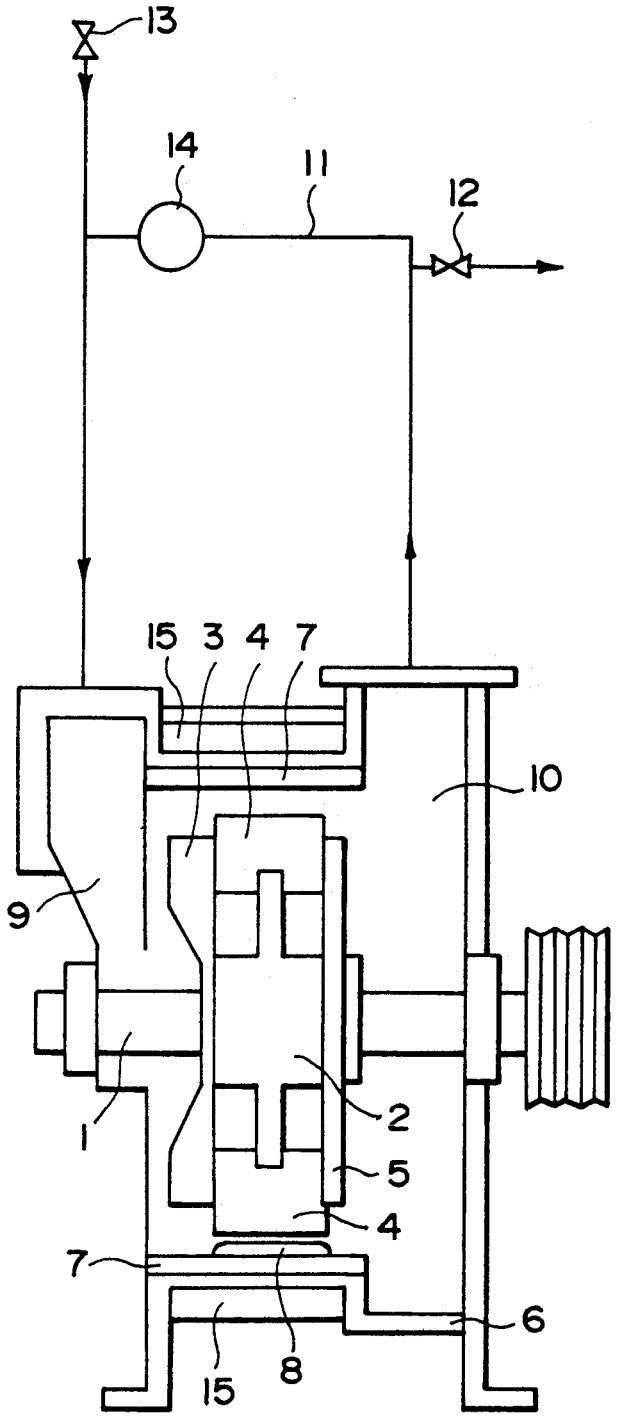
FIG. 5 is a schematic illustration of an embodiment of an apparatus for embedding particles (B) onto particles (A).

In the case of the external addition, it is particularly preferred to attach or embed the urea derivative to the surface of fine toner particles comprising a binder resin and a colorant by using an apparatus as shown in FIG. 5. Referring to FIG. 5, a mixture of a toner and a urea derivative are charged through an inlet 13 and an entrance chamber 9 to a central zone defined by a casing 6 of the apparatus, wherein dispersion vanes 3 and blades 4 are rotated about a shaft 1 driven by a motor (not shown) to apply an impacting force to the mixture at an impact zone 8 between the blade 4 and a liner 7. Then, the mixture is withdrawn through an outlet chamber 10, a return pipe 11 and a blower 10 to be recycled to the apparatus. After the treatment, the toner particles carrying the urea derivative are withdrawn from a product withdrawal outlet 10. The blades 4 are supported by a rotor 2 which is placed at a part separated from the outlet chamber 10 by a partition plate 5. During the treatment, the temperature within the apparatus is controlled, as desired, by passing cooling water through a jacket 15.

The blades 4 may preferably be rotated at a peripheral speed of 30–130 m/sec, more preferably 30–100 m/sec. The blades 4 and the liner 7 may preferably be disposed with a spacing therebetween of about 0.5–10 mm, more preferably 1–7 mm, so as to provide good results. The liner 7 may assume any shapes, inclusive of a wave, a sawtooth and a flat plate.

It is possible to use the urea derivative according to the present invention in combination with a conventional charge controller.

The toner according to the present invention can be used in combination with silica fine powder externally added thereto. The silica fine powder may be produced through either the dry process or the wet process.

The dry process mentioned above refers to a process for producing silica fine powder by vapor phase oxidation of a silicon halide. Such fine silica powder may, for example, be obtained by pyrolytic oxidation of gaseous silicon tetrachloride in oxygen-hydrogen flame The basic reaction scheme may be represented as follows:

$$SiCl_4+2H_2+O_2 \rightarrow SiO_2+4HCl$$

In the above preparation step, it is also possible to obtain complex fine powder of silica and other metal oxides by using other metal halides such as aluminum chloride or titanium chloride together with silicon halides. Such is also included in the silica fine powder to be used in the present invention.

On the other hand, in order to produce silica fine powder to be used in the present invention through the wet process, for example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica fine power to be used herein may be anhydrous silicon dioxide (silica), and also a silicate such as aluminum silicate, sodium silicate, potassium silicate, magnesium silicate and zinc silicate.

The silica fine powder may preferably have a specific surface area of at least 30 $m^2/g$, more preferably 50–400 $m^2/g$, as measured by the BET method according to nitrogen adsorption.

The silica fine powder used in the present invention may have been treated with an agent, such as a silane coupling agent or organic silicon compound, for the purpose of imparting a hydrophobicity, etc. More specifically, silica fine powder may be treated with such a treating agent reactive with or physically adsorbed onto the silica fine powder. Examples of such a treating agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorsilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinylmethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

The silica fine powder used in the present invention may preferably have a hydrophobicity of 30–80 according to the methanol titration test as measured after such a treatment as described above so as to provide a developer containing the silica fine powder with a sharp and uniform triboelectric chargeability. According to the methanol titration test, the degree of hydrophobicity of the silica fine powder having a hydrophobicity-imparted surface is determined.

The methanol titration test used herein may be conducted in the following manner. Sample silica powder (0.2 g) is charged into 50 ml of water in a 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the silica powder is suspended in the liquid, and the hydrophobicity is represented by the percentage of the methanol in the liquid mixture of water and methanol on reaching the end point.

The colorant to be used in the developer of the present invention may be one or a mixture of known dyes or pigments including Carbon Black, Lamp Black, Iron Black, ultramarine blue, nigrosine dyes, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo dyes and pigments and disazo dyes and pigments.

The binder resin for the developer of the present invention may for example be composed of: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, cumarone-indene resin and petroleum resin.

The binder resin may have been crosslinked, and a crosslinked styrene copolymer is particularly preferred.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

In the case of using a pressure-fixation system, there may be used a binder resin for a pressure-fixable toner, examples of which may include: polyethylene, polypropylene, polybutylene, polyurethane elastomer, ethylene-ethyl acrylate copolymer, ethylene-vinyl acetate copolymer, ionomer resin, styrene-butadiene copolymer, styrene-isoprene copolymer, linear saturated polyester and paraffins.

The toner constituting the developer according to the present invention can be composed as a magnetic toner by incorporating therein a magnetic material. The magnetic material may be one or a mixture of: iron oxides, such as magnetite, γ-iron oxide, ferrite, and excessive iron-containing ferrite; metals, such as iron, cobalt and nickel, and alloys of these metals with other metals, such as aluminum cobalt, copper, zinc, lead, magnesium, tin, zinc, antimony, beryllium, bismuth, cadmium, calcium, manganese, selenium, titanium, tungsten and vanadium; and mixture of the above. These magnetic materials may preferably have an average particle size of 0.1–1 micron, more preferably 0.1–0.5 micron and may preferably be contained in an amount of 40–150 wt. parts, more preferably 60–120 wt. parts, per 100 wt. parts of the binder resin.

The toner containing the charge controller according to the present invention may have a weight-average particle size of 3–15 microns. In view of the developing performance, it is particularly preferred that the toner has a weight-average particle size of 4–10 microns and contains 12–60% by number of toner particles having a particle size of 5 microns or smaller, 1–33% by number of toner particles having a particle size of 8–12.7 microns, and 2.0 wt. or less of toner particles having a particle size of 16 microns or larger.

While particle size distribution of a toner may suitably be measured by means of a Coulter counter in the present invention, it may be measured in other various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected. For measurement, a 1%-NaCl aqueous solution as an electrolytic solution is prepared by using a reagent-grade sodium chloride. For example, ISOTONR-II (available from Coulter Scientific Japan K.K.) may be used therefor. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution.

The developer according to the present invention may also be constituted as a two-component type developer by mixing a toner with a carrier. The carrier particles used for this purpose may be those known in the art including, for example, powder or particles of magnetic metals, such as iron, ferrite and nickel; glass beads; and these particles further coated with resins. Examples of such coating resins may include: styrene-acrylate copolymer, styrene-methacrylate copolymer, other acrylate copolymers and methacrylate copolymers, silicone resin, fluorine-containing resin, polyamide resin, ionomer resin and polyphenylene sulfide resin. These resins may be used singly or in mixture.

The developer according to the present invention may further contain optional additives, examples of which may include: lubricants, such as zinc stearate; abrasives, such as cerium oxide, and silicon carbide; fluidity-imparting agents, such as aluminum oxide; anticaking agent; and electroconductivity-imparting agents, such as carbon black and tin oxide. It is also possible to add fine powder of a fluorine-containing polymer, such as polyvinylidene fluoride, as a preferable additive, in order to provide fluidity, abrasive-characteristic and charge-stability.

It is also possible to incorporate a releasing substance in a toner so as to improve the releasability at the time of hot roller fixation. Examples of the releasing substance may include waxy substances, such as low-molecular weight polyethylene, low-molecular weight polypropylene, microcrystalline wax, carnauba wax, sasol wax, and paraffin wax. Such a releasing substance may be added in a proportion of about 0.5–5 wt. % of the toner.

The toner according to the present invention may preferably be prepared through a process wherein the above-mentioned toner constituents are sufficiently blended in a blender such as a ball mill, well kneaded by a hot kneading means such as a hot roller kneader or an extruder, cooled to be solidified, mechanically pulverized and classified to provide a toner. It is however also possible to adopt other methods, such as a method of dispersing constituent materials in a binder resin solution and spray-drying the dispersion; a method of incorporating prescribed materials into a core material, a shell material or both of these constituting a so-called micro-capsule toner; and a polymerization method of dispersing prescribed materials in a monomer constituting the binder resin to form an emulsion or suspension, and polymerizing the emulsion or suspension.

The thus obtained toner may be further blended with other additives as desired by means of a blender, such as a Henschel mixer, to provide a developer according to the present invention.

The developer according to the present invention may be applicable to any known methods of developing electrostatic images inclusive of electrophotography, electrostatic recording and electrostatic printing.

Figure 6:
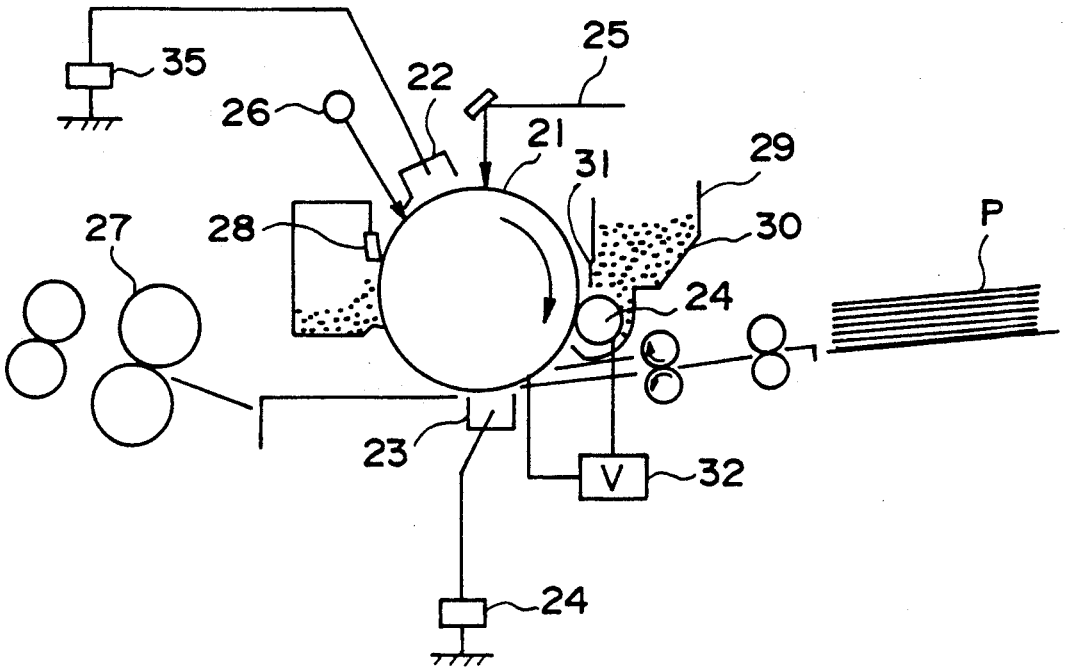
FIG. 6 is an illustration of an embodiment of the image forming apparatus according to the present invention.
Figure 7:
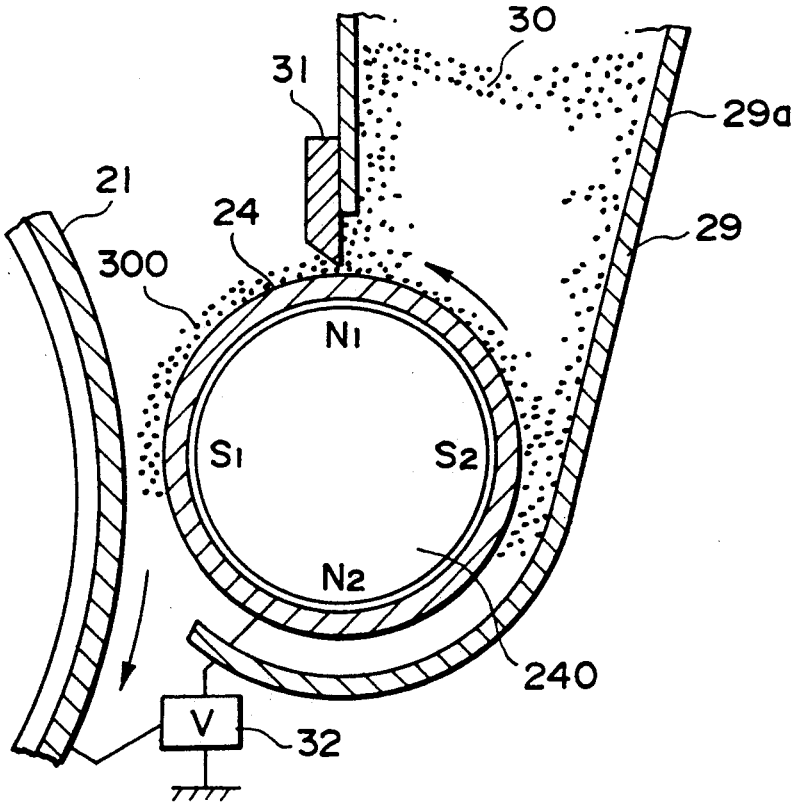
FIG. 7 is a partially enlarged view of the developing zone of the apparatus shown in FIG. 6.

Now, the image forming apparatus according to the present invention will be explained with reference to FIGS. 6 and 7.

The apparatus includes a photosensitive drum 21 of, e.g., an OPC (organic photoconductor) as an electrostatic image-bearing member and a charger 22 for charging the photosensitive drum 21. A prescribed voltage is supplied to the charger 22 from a power supply unit 35. Also a prescribed bias voltage is supplied to a transfer charger 23 as a transfer means from a constant voltage supply 34. Preferred bias conditions include a current value of 0.1–50 μA and a voltage value (absolute) of 500 to 4000 volts.

The photosensitive drum 21 surface is charged to, e.g., a negative polarity by the charger 22 connected to the power supply unit 35 (voltage application means) and exposed image light from exposure means 26 as a latent image-forming means to form an electrostatic latent image thereon. Then, the latent image is subjected to, e.g., reverse-development with a monocomponent-type negatively chargeable magnetic developer 30 contained in a developing apparatus 29 equipped with a magnetic iron blade 31 and a non-magnetic developing sleeve 24 (developer-carrying member) containing therein a magnet 240. The developing sleeve 24 comprises, e.g., a cylinder of stainless steel (SUS 304)

having a diameter of 50 mm and plural sphere-traced surface concavities thereon. At the developing station or zone, an alternating bias, a pulsed bias and/or a DC bias is applied between the conductive substrate of the photosensitive drum 21 and the developing sleeve 24 by a bias application means 32. A sheet of transfer paper P is conveyed to reach a transfer station, where the back side (opposite side with respect to the photosensitive drum) of the transfer paper is charged by the transfer charger 23, whereby a developed image (toner image) on the photosensitive drum surface is electrostatically transferred to the transfer paper P. The transfer paper P separated from the photosensitive drum 1 is sent to a hot pressure roller fixer 27 where the toner image on the transfer paper P is fixed.

Some magnetic developer remaining on the photosensitive drum 21 after the transfer step is removed by a cleaning device 28 equipped with a cleaning blade. The photosensitive drum 21 is discharged by an erasing exposure light source 26 and is subjected to a repeating cycle starting with the charging step by the primary charger 22.

The photosensitive drum 21 comprises an OPC photosensitive layer on an electroconductive substrate and rotates in the direction of the arrow. The developing sleeve 24 as a developer-carrying member comprising a non-magnetic cylinder rotates so as to move in the same direction as the photosensitive drum 21 surface at the developing station. Inside the developing sleeve 24 is disposed a multi-polar permanent magnet 240 (magnet roll) so as not to rotate. The multi-polar permanent magnet 240 may preferably be set to 500–900 Gauss at a pole N1, 600–1100 Gauss pole N2, 800–1500 Gauss at a pole S1 and 400–800 Gauss at a pole S2. The magnetic developer 30 in the developing device 29 is applied onto the developing sleeve 24 and the developer particles are provided with, e.g., a negative charge due to friction, e.g., between the developing sleeve 24 surface and the developer particles. The magnetic doctor blade 31 of iron is disposed in proximity with the cylindrical developing sleeve surface with a gap of about 50 microns to 500 microns and so as to confront one magnetic pole of the multi-polar permanent magnet, whereby a magnetic toner layer is formed in a thin and uniform thickness (30–300 microns) so that the magnetic developer layer is thinner than the gap between the photosensitive drum 21 and the developing sleeve 24 at the developing station. The revolution speed of the developing sleeve 24 is adjusted so that the sleeve surface velocity is substantially the same as or close to the speed of the photosensitive drum 21 surface. It is possible to compose the magnetic doctor blade 31 of a permanent magnet instead of iron. At the developing station, it is possible to apply an AC bias or a pulsed bias between the developing sleeve 24 and the photosensitive drum 21 surface by the biasing means 32. The AC bias may appropriately comprise a frequency f of 900–1600 Hz and a peak-to-peak voltage Vpp of 1500–2300 V, and the DC bias may appropriately be −100 to −350 volts.

At the developing station, the developer particles are transferred to the photosensitive drum side while reciprocating between the developing sleeve 24 and the photosensitive drum 21 because of an electrostatic force exerted by the electrostatic image-bearing member surface and the action of the AC bias or pulsed bias electric field.

Instead of the magnetic doctor blade 31, an elastic blade formed of an elastic material such as silicone rubber can also be used to apply the developer 300 n a regulated thickness onto the developing sleeve 24 under the action of a pressing force.

Instead of the OPC photosensitive drum, it is possible to use an insulating drum for electrostatic recording, or a photosensitive drum having a layer of a photoconductive insulating substance, such as a-Se, CdS, $ZnO_2$ or a-Si in appropriate selection depending on the developing conditions, as the photosensitive drum 21.

In the image forming apparatus, plural members inclusive of some of the above-mentioned members such as the photosensitive drum (image-bearing member), developing means, charging means and cleaning means can be integrally combined to form an apparatus unit so that the unit can be connected to or released from the apparatus body. For example, at least one of the charging means, photosensitive drum and cleaning means can be integrally combined with the developing means to form a single unit so that it can be attached to or released from the apparatus body including the remainder of the image forming apparatus by a guide means such as a guide rail provided to the body. In this instance, it is also possible to compose such an apparatus unit by the charging means, cleaning means and/or photosensitive drum.

Figure 8:
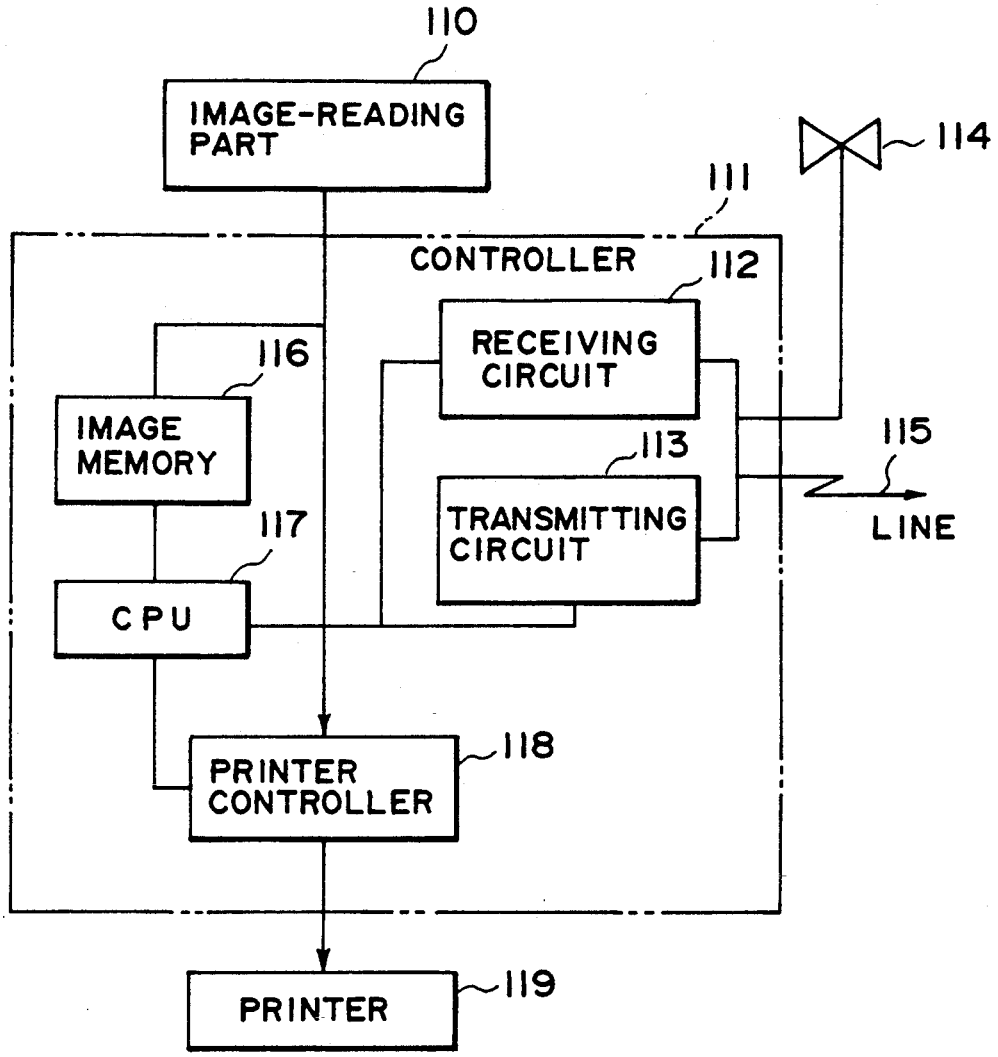
FIG. 8 is a block diagram of a facsimile apparatus incorporating such an image forming apparatus as a printer.

In case where the image forming apparatus according to the present invention is used as a printer for facsimile, the image light 25 as a latent image forming means may be replaced by digital light image of laser light for printing received data. FIG. 8 is a block diagram for illustrating such an embodiment.

Referring to FIG. 8, a controller 111 controls an image reader (or image reading unit) 110 and a printer 119. The entirety of the controller 111 is regulated by a CPU 117. Data read from the image reader 110 is transmitted through a transmitter circuit 113 to a remote terminal such as another facsimile machine. On the other hand, data received from a remote terminal is transmitted through a receiver circuit 112 to a printer 119. An image memory 116 stores prescribed image data. A printer controller 118 controls the printer 119. A telephone handset 114 is connected to the receiver circuit 112 and the transmitter circuit 113.

More specifically, an image received from a line (or circuit) 115 (i.e., image data received from a remote terminal connected by the line) is demodulated by means of the receiver circuit 112, decoded by the CPU 117, and sequentially stored in the image memory 116. When image data corresponding to at least one page is stored in the image memory 116, image recording or output is effected with respect to the corresponding page. The CPU 117 reads image data corresponding to one page from the image memory 116, and transmits the decoded data corresponding to one page to the printer controller 118. When the printer controller 118 receives the image data corresponding to one page from the CPU 117, the printer controller 118 controls the printer 119 so that image data recording corresponding to the page is effected. During the recording by the printer 119, the CPU 117 receives another image data corresponding to the next page.

As described above, the urea derivative according to the present invention is little liable to soil the developer-carrying member, is colorless or only light-colored, is thermally and mechanically stable and has good triboelectric chargeability.

Accordingly, the developer prepared by using the urea derivative is not readily affected by changes in temperature and humidity and does not readily cause image quality deterioration during continuous copying, thus being able to provide images having an excellent uniformity of density. Further, the developer is excellent in storage stability and causes little decrease in triboelectric chargeability by a long term of storage. When the urea derivative is used to form a color toner, the color toner can provide clear images. Further, the urea derivative can have a remarkably different levels of triboelectric chargeability by using different kinds of substituents so that the developer according to the present invention can be applied to a variety of developing methods.

EXAMPLES

Hereinbelow, the present invention is described in more detail based on Examples. In the Examples, "part(s)" used in describing formulations are all by weight.

Example 1

| | |
|---|---|
| Styrene/n-butyl methacrylate copolymer | 100 wt. parts |
| Carbon black | 5 wt. parts |
| Compound Example (1) in a parachloro-substituted form | 2 wt. parts |

The above ingredients were well blended in a blender and kneaded through a twin-screw extruder set at 150° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover black fine powder (toner) having a weight-average particle size of 8.5 microns. The thus obtained black fine powder contained 23% by number of particles having a particle size of 5 microns or below, 26% by number of particles having a particle size of 8–12.7 microns, and 0.3 wt. % of particles having a particle size of 16 microns or larger.

0.6 part of hydrophobic silica fine powder treated with dimethyldichlorosilane was added to 100 parts of the black fine powder, and the mixture was blended in a Henschel mixer to obtain a toner (containing silica fine powder). The toner in an amount of 5 g was mixed with 96 g of carrier to measure the triboelectric charge thereof by the flow-off method in a normal temperature/normal humidity environment of 23° C./60%RH, whereby a value of −28° C./g was obtained.

Then, 5 parts of the toner (with silica) was mixed with 100 parts of an acrylic resin-coated ferrite carrier having an average particle size of 65 microns to obtain a two-component type developer.

The two-component type developer was subjected to a copying test by using a commercially available color electrophotographic copier ("CLC-500", available from Canon K.K.).

As a result, under the normal temperature/normal humidity environmental conditions of 23° C./60%RH, clear black images having an image density of 1.51 were obtained from the initial stage and no deterioration was observed even after copying of $10^4$ sheets Then, a similar copying test was performed under the low temperature/low humidity conditions of 15° C./10%RH, whereby images having a high density of 1.47 were obtained from the initial stage. Further, under the high temperature/high humidity conditions of 35° C./85%RH, good images having a density of 1.55 were obtained.

Example 2

Blue fine powder (toner) having a weight-average particle size of 8.3 microns was prepared and mixed with silica fine powder in the same manner as in Example 1 except that the 5 parts of carbon black was replaced by 4 parts of a copper phthalocyanine pigment (C.I. Pigment Blue 15). The toner (with silica) was further blended with the same carrier in the same ratio as in Example 1 to obtain a two-component type developer.

The developer was subjected to the same copying test as in Example 1 whereby, under the conditions of 23° C./60%RH, clear blue images free from fog and having a density of 1.56 were obtained from the initial stage. No image quality deterioration was observed even after copying of $10^4$ sheets. As a result of the copying tests under 35° C./85%RH and 15° C./10% RH, similarly good results as under 23° C./60% RH were obtained.

Example 3

Red fine powder (toner) having a weight-average particle size of 8.2 microns was prepared and mixed with silica fine powder in the same manner as in Example 1 except that the 5 parts of carbon black was replaced by 4 parts of a quinacridone pigment (C.I. Pigment Red 122). The toner (with silica) was further blended with the same carrier in the same ratio as in Example 1 to obtain a two-component type developer.

The developer was subjected to the same copying test as in Example 1 whereby, under the conditions of 23° C./60%RH, clear magenta images free from fog and having a density of 1.57 were obtained from the initial stage. No image quality deterioration was observed even after copying of $10^4$ sheets. As a result of the copying tests under 35° C./85%RH and 15° C./10%RH, similarly good results as under 23° C./60% were obtained.

Example 4

Yellow fine powder (toner) having a weight-average particle size of 8.1 microns was prepared and mixed with silica fine powder in the same manner as in Example 1 except that the 5 parts of carbon black was replaced by 4 parts of a yellow pigment (C.I. Pigment Yellow 17). The toner (with silica) in an amount of 6 parts was further blended with 100 parts of the same carrier as in Example 1 to obtain a two-component type developer.

The developer was subjected to the same copying test as in Example 1 whereby, under the conditions of 23° C./60%RH, clear yellow images free from fog and having a density of 1.53 were obtained from the initial stage. No image quality deterioration was observed even after copying of $10^4$ sheets. As a result of the copying tests under 35° C./85%RH and 15° C./10%RH, similarly good results as under 23° C./60% were obtained.

Full color images were formed by using the black, cyan, magenta and yellow developers prepared by Examples 1–4, whereby clear full color images were provided with good color mixing characteristic and gradation characteristic.

Comparative Example 1

Black fine powder (toner) having a weight-average particle size of 8.4 microns was prepared and mixed with silica fine powder in the same manner as in Example 1 except that the 2 parts of Compound Example 1 was replaced by 2 parts of N,N'-bis(4-chlorophenyl)thiourea. The toner showed a triboelectric charge of −11 μC/g as measured according to the same method as in Example 1. The toner (with silica) was further blended with the same carrier in the same ratio as in Example 1 to obtain a two-component type developer.

The developer was subjected to the same copying test as in Example 1 under the conditions of 23° C./60%RH, whereby an image having an image density of 1.39 was obtained. However, in the continuous copying test for examining durability, the image density was lowered to 1.20 on a 2000-th sheet which also showed ground fog in a practically problematic degree. As a result of inspection after the copying test, conspicuous toner scattering was observed in the copying apparatus, so that the toner was judged as commercially unacceptable.

Example 6

| | |
|---|---|
| Styrene/n-butyl methacrylate copolymer | 100 wt. parts |
| Magnetic material | 80 wt. parts |
| Low-molecular weight polypropylene wax | 3 wt. parts |
| Compound Example (2) in a parafluoro-substituted form | 3 wt. parts |

The above ingredients were well blended in a blender and kneaded through a twin-screw extruder set at 140° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover black fine powder (toner) having a weight-average particle size of 8.3 microns.

0.6 part of hydrophobic silica fine powder treated with hexamethyldisilazane was added to 100 parts of the black fine powder, and the mixture was blended in a Henschel mixer to obtain a monocomponent-type developer.

The monocomponent-type developer thus obtained was subjected to a copying test by using a commercially available copying machine ("NP-6650", available from Canon K.K.) under the environmental conditions of 23° C./60% RH (normal temperature/normal humidity), whereby clear images free from fog and roughness having an image density of 1.41 were obtained at a resolution of 6.3 lines/mm. Further, on continuous copying of $3\times10^4$ sheets for evaluation of durability, it was possible to obtain good images having an image density of 1.39 and a resolution of 6.3 lines/mm which were thus not inferior to the images at the initial stage. The triboelectric charge of the developer on the developing sleeve was measured to be −11.5 μC/g at the initial stage and −10.7 μC/g after copying $3\times10^4$ sheets, and almost no soiling was observed on the sleeve. Then, a copying test was performed under the conditions of 15° C./10%RH, similarly good images were obtained at a high density. Similarly good results were obtained in a continuous copying test of $3\times10^4$ sheets. Similar copying test and continuous copying test were performed under the conditions of 35° C./85%RH, whereby good results were obtained. The developer was further left standing for 1 month under the conditions and then subjected to the same copying test and continuous copying test, whereby satisfactory results of no problem were obtained.

Example 7

Black fine powder (magnetic toner) having a weight-average particle size of 11.4 microns was prepared in the same manner as in Example 6 except that the 3 parts of Compound Example (2) was replaced by 3 parts of Compound Example (3) in a parachloro-substituted form and the amount of the magnetic material was reduced from 80 parts to 60 parts.

Then, 0.5 wt. part of hydrophobic silica fine powder treated with silicone oil was added to 100 parts of the black fine powder, followed by blending with a Henschel mixer, to obtain a monocomponent-type developer.

The monocomponent-type developer thus obtained was subjected to a copying test by using a commercially available copying machine ("NP-6650", available from Canon K.K.) under the environmental conditions of 23° C./60% RH (normal temperature/normal humidity), whereby clear images free from fog and roughness having a high image density of 1.40 were obtained. Further, on continuous copying of $3\times10^4$ sheets for evaluation of durability, it was possible to obtain good images not inferior to the images at the initial stage. The triboelectric charge of the developer on the developing sleeve was measured to be −10.6 μC/g at the initial stage and −10.2 μC/g after copying $3\times10^4$ sheets, and almost no soiling was observed on the sleeve. Then, a copying test was performed under the conditions of 15° C./10%RH, similarly good images were obtained at a high density. Similarly good results were obtained in a continuous copying test of $3\times10^4$ sheets Similar copying test and continuous copying test were performed under the conditions of 35° C./85%RH, whereby good results were obtained. The developer was further left standing for 1 month under the conditions and then subjected to the same copying test and continuous copying test, whereby satisfactory results of no problem were obtained.

Example 8

| | |
|---|---|
| Styrene/n-butyl methacrylate copolymer | 100 parts |
| Copper-phthalocyanine pigment (C. I. Pigment Blue 15) | 5 parts |
| Low-molecular weight polypropylene wax | 3 parts |
| Compound Example (4) in a ortho-chloro-substituted form | 4 parts |

A blue fine powder (toner) having a weight average particle size of 11.5 microns was prepared from the above ingredients otherwise in a similar manner as in Example 6.

0.5 wt. part of hydrophobic silica fine powder treated with dimethyldichlorosilane was added to 100 parts of the blue fine powder thus obtained, followed by blending by using a Henschel mixer to obtain a toner (with silica). Then, 7 parts of the toner (with silica) was blended with 100 parts of an acrylic resin-coated ferrite carrier having an average particle size of 65 microns to obtain a two-component type developer.

The two-component type developer thus obtained was subjected to a copying test using a commercially available copying machine ("NP-6650", available from Canon K.K.) under the environmental conditions of 23° C./60%RH, whereby good images having an image density of 1.35 were obtained. When the two-component type developer was evaluated with respect to durability by continuous copying of 5000 sheets, whereby good images not inferior to the images at the initial stage were obtained.

Then, copying tests were performed under the conditions of 15 ° C./10 %, and the conditions of 35° C./85 %RH, whereby similarly good results were obtained under the respective conditions.

Example 9

| | |
|---|---|
| Polyester (acid value: 9.5 mgKOH/g, hydroxyl value: 16.3 mgKOH/g | 100 parts |
| Carbon black | 5 parts |
| Compound Example (5) in a meta-nitro-substituted form | 2 parts |

A black fine powder (toner) having a weight average particle size of 8.2 microns was prepared from the above ingredients otherwise in a similar manner as in Example 1.

0.6 wt. part of hydrophobic silica fine powder treated with hexamethyldisilazane was added to 100 parts of the black fine powder thus obtained, followed by blending by using a Henschel mixer to obtain a toner (with silica). Then, 6 parts of the toner (with silica) was blended with 100 parts of an acrylic resin-coated ferrite carrier having an average particle size of 65 microns to obtain a two-component type developer.

The two-component type developer thus obtained was subjected to a copying test using a commercially available color copying machine ("CLC-500", available from Canon K.K.) under the environmental conditions of 23 ° C./60 %RH, whereby clear images having an image density of 1.42 were obtained from the initial stage, and no image quality deterioration was observed even after copying of $10^4$ sheets.

As a result of a copying test under the conditions of 15 ° C./10%RH, images having a high density of 1.38 were obtained from the initial stage. Also under the conditions of 35 ° C./85%RH, good images having a density of 1.48 were obtained.

Example 10

| | |
|---|---|
| Styrene/2-ethylhexyl acrylate | 90 wt. parts |
| Styrene/butadiene copolymer | 10 wt. parts |
| Magnetite | 75 wt. parts |
| Low-molecular weight polypropylene | 4 wt. parts |

The above ingredients were well blended in a blender and kneaded through a twin-screw extruder set at 150° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover fine powder having a weight-average particle size of 8.7 microns.

To 100 parts of the fine powder, 1.0 part of Compound Example (6) in a 4-fluoro-substituted form and 0.3 part of silica fine powder as additive materials were added, and the mixture was pre-treated by blending by a Henschel mixer.

Then, the mixture was subjected to 5 min. of an attaching-embedding treatment by means of an apparatus as shown in FIG. 5 under the conditions of a minimum blade clearance of 1 mm and a blade peripheral speed of 60 m/sec. As a result of observation of the treated product through an electron microscope, it was observed that the additive materials were attached to and partially embedded in the surface of the toner particles. Further, to 100 parts of the thus treated product, 0.5 part of hydrophobic silica fine powder treated with hexamethyldisilazane was added and blended, to obtain a mono-component type developer.

The monocomponent-type developer thus obtained was subjected to a copying test by using a commercially available copying machine ("NP-6650", available from Canon K.K.) under the environmental conditions of 23° C./60% RH (normal temperature/normal humidity), whereby clear images free from fog and roughness having an image density of 1.38 were obtained at a resolution of 6.3 lines/mm. Further, on continuous copying of $2\times10^4$ sheets for evaluation of durability, it was possible to obtain good images having an image density of 1.32 which were thus not inferior to the images at the initial stage. Then, a copying test was performed under the conditions of 15 ° C./10%RH, similarly good images were obtained at a high density. Similarly good results were obtained in a continuous copying test of $2\times10^4$ sheets. Similar copying test and continuous copying test were performed under the conditions of 35° C./85%RH, whereby good results were obtained.

Example 11

| | |
|---|---|
| Styrene/n-butyl methacrylate copolymer | 100 wt. parts |
| Magnetic material | 80 wt. parts |
| Low-molecular weight polypropylene wax | 3 wt. parts |
| Compound Example (2) in a parafluoro-substituted form | 1 wt. parts |

The above ingredients were well blended in a blender and kneaded through a twin-screw extruder set at 140° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover black fine powder (toner) having a weight-average particle size of 8.1 microns.

0.6 part of hydrophobic silica fine powder treated with dimethyl silicone oil was added to 100 parts of the black fine powder, and the mixture was blended in a Henschel mixer to obtain a monocomponent-type developer.

The monocomponent-type developer thus obtained was subjected to a copying test by using a commercially available laser beam printer ("LBP-8II", available from Canon K.K.) under the environmental conditions of 23° C./60% RH (normal temperature/normal humidity), whereby clear images free from fog having an image density of 1.41 were obtained. Further, on continuous copying of 3000 sheets for evaluation of durability, it was possible to obtain good images having an image density of 1.40 which were thus not inferior to the images at the initial stage. Then, a copying test was performed under the conditions of 15° C./10%RH, similarly good images were obtained at a high density. Similarly good results were obtained in a continuous copying test of 3000 sheets. Similar copying test and continuous copying test were performed under the conditions of 35 ° C./85%RH, whereby good results were obtained.

Example 12

| | |
|---|---|
| Styrene/n-butyl methacrylate copolymer | 100 wt. parts |
| Carbon black | 5 wt. parts |
| Compound Example (21) in a paramethyl-substituted form | 2 wt. parts |

The above ingredients were well blended in a blender and kneaded through a twin-screw extruder set at 150° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover black fine powder (toner) having a weight-average particle size of 7.9 microns.

0.6 part of hydrophobic silica fine powder treated with dimethyldichlorosilane was added to 100 parts of the black fine powder, and the mixture was blended in a Henschel mixer to obtain a toner (containing silica fine powder). The triboelectric charge of the toner was measured to be $-24\ \mu C/g$ by the blow-off method.

Then, 5 parts of the toner (with silica) was mixed with 100 parts of an acrylic resin-coated ferrite carrier having an average particle size of 65 microns to obtain a two-component type developer.

The two-component type developer was subjected to a copying test by using a commercially available color electrophotographic copier ("CLC-500", available from Canon K.K.).

As a result, under the normal temperature/normal humidity environmental conditions of 23° C./60%RH, clear black images having an image density of 1.47 were obtained from the initial stage and no deterioration was observed even after copying of $10^4$ sheets.

Then, a similar copying test was performed under the low temperature/low humidity conditions of 15° C./10%RH, whereby images having a high density of 1.43 were obtained from the initial stage. Further, under the high temperature/high humidity conditions of 35° C./85%RH, good images having a density of 1.52 were obtained.

Example 13

Blue fine powder (toner) having a weight-average particle size of 8.5 microns was prepared and mixed with silica fine powder in the same manner as in Example 12 except that the 5 parts of carbon black was replaced by 4 parts of a copper phthalocyanine pigment (C.I. Pigment Blue 15). The toner (with silica) was further blended with the same carrier in the same ratio as in Example 12 to obtain a two-component type developer.

The developer was subjected to the same copying test as in Example 12 whereby, under the conditions of 23° C./60%RH, clear blue images free from fog and having a density of 1.48 were obtained from the initial stage. No image quality deterioration was observed even after copying of $10^4$ sheets. As a result of the copying tests under 35 ° C./85%RH and 15° C./10 RH, similarly good results as under 23° C./60% RH were obtained.

Example 14

Red fine powder (toner) having a weight-average particle size of 8.0 microns was prepared and mixed with silica fine powder in the same manner as in Example 12 except that the 5 parts of carbon black was replaced by 4 parts of a quinacridone pigment (C.I. Pigment Red 122). The toner (with silica) was further blended with the same carrier in the same ratio as in Example 12 to obtain a two-component type developer.

The developer was subjected to the same copying test as in Example 12 whereby, under the conditions of 23° C./60%RH, clear magenta images free from fog and having a density of 1.49 were obtained from the initial stage. No image quality deterioration was observed even after copying of $10^4$ sheets. As a result of the copying tests under 35° C./85%RH and 15° C./10%RH, similarly good results as under 23° C./60% RH were obtained.

Example 15

Yellow fine powder (toner) having a weight-average particle size of 8.3 microns was prepared and mixed with silica fine powder in the same manner as in Example 12 except that the 5 parts of carbon black was replaced by 4 parts of a yellow pigment (C.I. Pigment Yellow 17). The toner (with silica) in an amount of 6 parts was further blended with 100 parts of the same carrier as in Example 12 to obtain a two-component type developer.

The developer was subjected to the same copying test as in Example 12 whereby, under the conditions of 23° C./60%RH, clear yellow images free from fog and having a density of 1.46 were obtained from the initial stage. No image quality deterioration was observed even after copying of $10^4$ sheets. As a result of the copying tests under 35° C./85%RH and 15° C./10%RH, similarly good results as under 23° C./60% RH were obtained.

Example 16

Full color images were formed by using the black, cyan, magenta and yellow developers prepared by Examples 12–15, whereby clear full color images were provided with good color mixing characteristic and gradation characteristic.

Example 17

| | |
|---|---|
| Styrene/n-butyl methacrylate copolymer | 100 wt. parts |
| Magnetic material | 80 wt. parts |
| Low-molecular weight polypropylene wax | 3 wt. parts |
| Compound Example (22) in a paraiso-propyl-substituted form | 3 wt. parts |

The above ingredients were well blended in a blender and kneaded through a twin-screw extruder set at 140° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K K.) for strict classification-removal of coarse powder fraction and ultra-fine powder fraction simultaneously, to recover black fine powder (toner) having a weight-average particle size of 8.0 microns.

0.6 part of hydrophobic silica fine powder treated with hexamethyldisilazane was added to 100 parts of the black fine powder, and the mixture was blended in a Henschel mixer to obtain a monocomponent-type developer.

The monocomponent-type developer thus obtained was subjected to a copying test by using a commercially available copying machine ("NP-6650", available from Canon K.K.) under the environmental conditions of 23° C./60% RH (normal temperature/normal humidity), whereby clear images free from fog and roughness having an image density of 1.39 were obtained at a resolution of 6.3 lines/mm. Further, on continuous copying of $3\times10^4$ sheets for evaluation of durability, it was possible to obtain good images having an image density of 1.36 and a resolution of 6.3 lines/mm which were thus not inferior to the images at the initial stage. The triboelectric charge of the developer on the developing sleeve was measured to be $-9.5$ $\mu$C/g at the initial stage and $-9.0$ $\mu$C/g after copying $3\times10^4$ sheets, and almost no soiling was observed on the sleeve. Then, a copying test was performed under the conditions of 15° C./10%RH, similarly good images were obtained at a high density. Similarly good results were obtained in a continuous copying test of $3\times10^4$ sheets. Similar copying test and continuous copying test were performed under the conditions of 35° C./85%RH, whereby good results were obtained. The developer was further left standing for 1 month under the conditions and then subjected to the same copying test and continuous copying test, whereby satisfactory results of no problem were obtained.

Example 18

Black fine powder (magnetic toner) having a weight-average particle size of 10.2 microns was prepared in the same manner as in Example 17 except that the 3 parts of Compound Example (22) was replaced by 3 parts of Compound Example (23) in a paramethoxy-substituted form and the amount of the magnetic material was reduced from 80 parts to 60 parts.

Then, 0.5 wt. part of hydrophobic silica fine powder treated with silicone oil was added to 100 parts of the black fine powder, followed by blending with a Henschel mixer, to obtain a monocomponent-type developer.

The monocomponent-type developer thus obtained was subjected to a copying test by using a commercially available copying machine ("NP-6650", available from Canon K.K.) under the environmental conditions of 23° C./60% RH (normal temperature/normal humidity), whereby clear images free from fog and roughness having a high image density of 1.36 were obtained. Further, on continuous copying of $3\times10^4$ sheets for evaluation of durability, it was possible to obtain good images not inferior to the images at the initial stage. The triboelectric charge of the developer on the developing sleeve was measured to be $-9.6$ $\mu$C/g at the initial stage and $-9.0$ $\mu$C/g after copying $3\times10^4$ sheets, and almost no soiling was observed on the sleeve. Then, a copying test was performed under the conditions of 15° C./10%RH, similarly good images were obtained at a high density. Similarly good results were obtained in a continuous copying test of $3\times10^4$ sheets. Similar copying test and continuous copying test were performed under the conditions of 35° C./85%RH, whereby good results were obtained. The developer was further left standing for 1 month under the conditions and then subjected to the same copying test and continuous copying test, whereby satisfactory results of no problem were obtained.

Example 19

| | |
|---|---|
| Styrene/n-butyl methacrylate copolymer | 100 parts |
| Copper-phthalocyanine pigment (C. I. Pigment Blue 15) | 5 parts |
| Low-molecular weight polypropylene wax | 3 parts |
| Compound Example (24) in a ortho-ethyl-substituted form | 4 parts |

A blue fine powder (toner) having a weight average particle size of 11.7 microns was prepared from the above ingredients otherwise in a similar manner as in Example 17.

0.5 wt. part of hydrophobic silica fine powder treated with dimethyldichlorosilane was added to 100 parts of the blue fine powder thus obtained, followed by blending by using a Henschel mixer to obtain a toner (with silica). Then, 7 parts of the toner (with silica) was blended with 100 parts of an acrylic resin-coated ferrite carrier having an average particle size of 65 microns to obtain a two-component type developer.

The two-component type developer thus obtained was subjected to a copying test using a commercially available copying machine ("NP-6650", available from Canon K.K.) under the environmental conditions of 23° C./60%RH, whereby good images having an image density of 1.32 were obtained When the two-component type developer was evaluated with respect to durability by continuous copying of 5000 sheets, whereby good images not inferior to the images at the initial stage were obtained.

Then, copying tests were performed under the conditions of 15° C./10%, and the conditions of 35° C./85%RH, whereby similarly good results were obtained under the respective conditions.

Example 20

| | |
|---|---|
| Polyester (acid value: 9.5 mgKOH/g, hydroxyl value: 16.3 mgKOH/g | 100 parts |
| Carbon black | 5 parts |
| Compound Example (25) in a meta- | 2 parts |

-continued

| |
|---|
| butyl-substituted form |

A black fine powder (toner) having a weight average particle size of 7.7 microns was prepared from the above ingredients otherwise in a similar manner as in Example 12.

0.6 wt. part of hydrophobic silica fine powder treated with hexamethyldisilazane was added to 100 parts of the black fine powder thus obtained, followed by blending by using a Henschel mixer to obtain a toner (with silica). Then, 6 parts of the toner (with silica) was blended with 100 parts of an acrylic resin-coated ferrite carrier having an average particle size of 65 microns to obtain a two-component type developer.

The two-component type developer thus obtained was subjected to a copying test using a commercially available color copying machine ("CLC-500", available from Canon K.K.) under the environmental conditions of 23° C./60%RH, whereby clear images having an image density of 1.44 were obtained from the initial stage, and no image quality deterioration was observed even after copying of $10^4$ sheets.

As a result of a copying test under the conditions of 15° C./10%RH, images having a high density of 1.36 were obtained from the initial stage. Also under the conditions of 35° C./85%RH, good images having a density of 1.48 were obtained.

Example 21

| | |
|---|---|
| Styrene/2-ethylhexyl acrylate | 90 wt. parts |
| Styrene/butadiene copolymer | 10 wt. parts |
| Magnetite | 75 wt. parts |
| Low-molecular weight polypropylene | 4 wt. parts |

The above ingredients were well blended in a blender and kneaded through a twin-screw extruder set at 150° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover fine powder having a weight-average particle size of 8.7 microns.

To 100 parts of the fine powder, 1.0 part of Compound Example (26) in a 4-amino-substituted form and 0.3 part of silica fine powder as additive materials were added, and the mixture was pre-treated by blending by a Henschel mixer.

Then, the mixture was subjected to 5 min. of an attaching-embedding treatment by means of an apparatus as shown in FIG. 5 under the conditions of a minimum blade clearance of 1 mm and a blade peripheral speed of 60 m/sec. As a result of observation of the treated product through an electron microscope, it was observed that the additive materials including the 4-amino-substituted compound were attached to and partially embedded in the surface of the toner particles. Further, to 100 parts of the thus treated product, 0.5 part of hydrophobic silica fine powder treated with hexamethyldisilazane was added and blended, to obtain a mono-component type developer.

The monocomponent-type developer thus obtained was subjected to a copying test by using a commercially available copying machine ("NP-6650", available from Canon K.K.) under the environmental conditions of 23° C./60% RH (normal temperature/normal humidity), whereby clear images free from fog and roughness having an image density of 1.32 were obtained at a resolution of 6.3 lines/mm. Further, on continuous copying of $2\times10^4$ sheets for evaluation of durability, it was possible to obtain good images having an image density of 1.28 which were thus not inferior to the images at the initial stage. Then, a copying test was performed under the conditions of 15° C./10%RH, similarly good images were obtained at a high density. Similarly good results were obtained in a continuous copying test of $2\times10^4$ sheets Similar copying test and continuous copying test were performed under the conditions of 35° C./85%RH, whereby good results were obtained.

Example 22

| | |
|---|---|
| Styrene/n-butyl methacrylate copolymer | 100 wt. parts |
| Magnetic material | 80 wt. parts |
| Low-molecular weight polypropylene wax | 3 wt. parts |
| Compound Example (22) in an ortho-isopropyl-substituted form | 1 wt. parts |

The above ingredients were well blended in a blender and kneaded through a twin-screw extruder set at 140° C. The kneaded product was cooled, coarsely crushed by a cutter mill and finely pulverized by a pulverizer using a jet air stream, followed by classification by means of a fixed wall-type wind force classifier. The resultant classified powder was further subjected to classification by a multi-division classifier ("Elbow Jet Classifier", available from Nittetsu Kogyo K.K.) for strict classification-removal of coarse powder fraction and ultra-fine powder fraction simultaneously, to recover black fine powder (toner) having a weight-average particle size of 8.3 microns.

0.6 part of hydrophobic silica fine powder treated with dimethyl silicone oil was added to 100 parts of the black fine powder, and the mixture was blended in a Henschel mixer to obtain a monocomponent-type developer.

The monocomponent-type developer thus obtained was subjected to a copying test by using a commercially available laser beam printer ("LBP-8II", available from Canon K.K.) under the environmental conditions of 23° C./60% RH (normal temperature/normal humidity), whereby clear images free from fog having an image density of 1.37 were obtained. Further, on continuous copying of 3000 sheets for evaluation of durability, it was possible to obtain good images having an image density of 1.34 which were thus not inferior to the images at the initial stage. Then, a copying test was performed under the conditions of 15° C./10%RH, similarly good images were obtained at a high density. Similarly good results were obtained in a continuous copying test of 3000 sheets. Similar copying test and continuous copying test were performed under the conditions of 35° C./85%RH, whereby good results were obtained.

What is claimed is:

1. A developer for developing electrostatic images, comprising: a toner containing a binder resin and a charge controller, said charge controller comprising an arylurea compound which comprises an arylurea having at least one electron-attracting group or electron-donating group, or a polyarylurea including such an arylurea as a recurring unit.

2. The developer according to claim 1, wherein said arylurea has an electron-attracting group.

3. The developer according to claim 2, wherein said arylurea comprises an N,N'-bisarylurea derivative represented by the following formula:

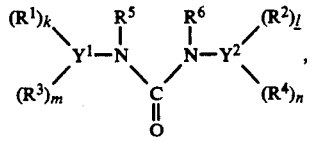

wherein $Y^1$ and $Y^2$ denote a phenyl or naphthyl group; $R^1$ and $R^2$ independently denote a halogen atom, nitro group, sulfonic acid group, carboxyl group, carboxylic acid ester group, cyano group or carbonyl group; $R^3$ and $R^4$ denote a hydrogen atom, alkyl group, alkoxy group, phenyl group capable of having a substituent, or aralkyl group capable of having a substituent; $R^5$ and $R^6$ denote a hydrogen atom or $C_1$–$C_8$ hydrocarbon group; k and l are 0, 1 or 2 satisfying $k+l \geqq 1$; and m and n are 1 or 2.

4. The developer according to claim 2, which is a monocomponent-type developer comprising the toner.

5. The developer according to claim 4, wherein said arylurea comprises an N,N'-bisarylurea derivative represented by the following formula:

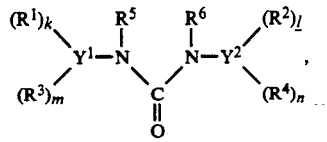

wherein $Y^1$ and $Y^2$ denote a phenyl or naphthyl group; $R^1$ and $R^2$ independently denote a halogen atom, nitro group, sulfonic acid group, carboxyl group, carboxylic acid ester group, cyano group or carbonyl group; $R^3$ and $R^4$ denote a hydrogen atom, alkyl group, alkoxy group, phenyl group capable of having a substituent, or aralkyl group capable of having a substituent; $R^5$ and $R^6$ denote a hydrogen atom or $C_1$–$C_8$ hydrocarbon group; k and l are 0, 1 or 2 satisfying $k+l \geqq 1$; and m and n are 1 or 2.

6. The developer according to claim 4, wherein said arylurea compound comprises at least one compound selected from the group consisting of:

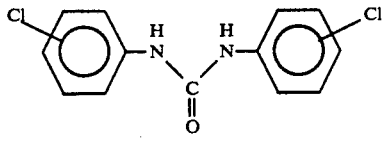

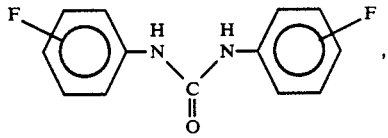

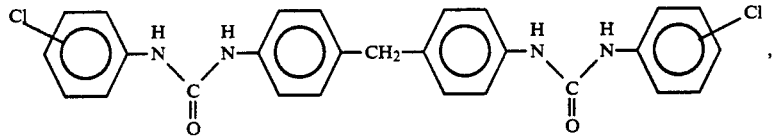

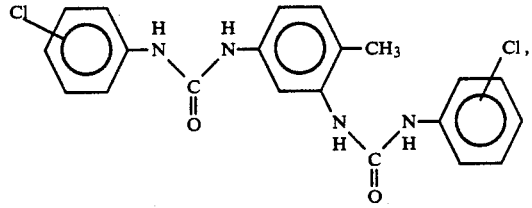

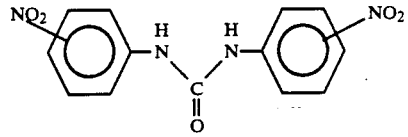

-continued
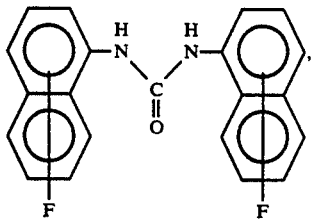
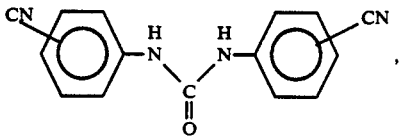
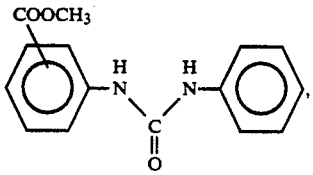
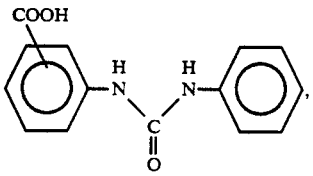
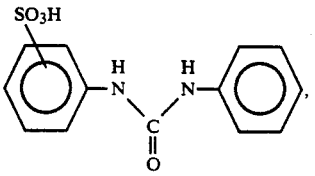
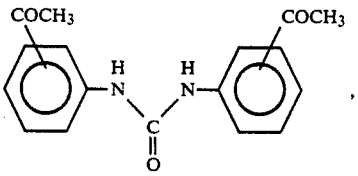
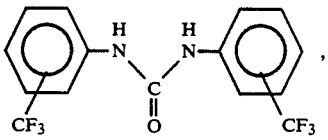
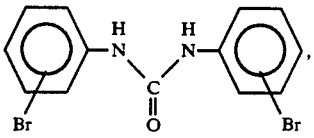
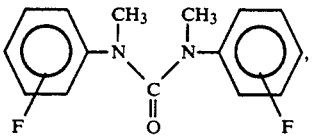

-continued

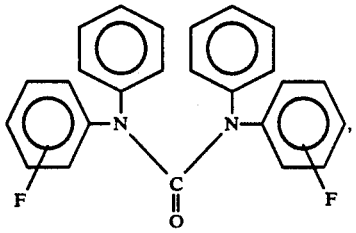

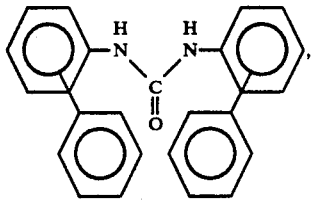

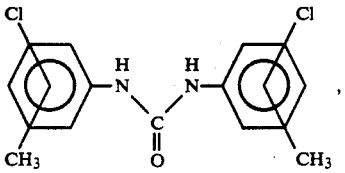

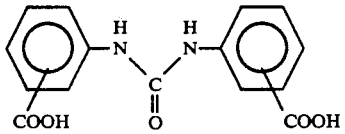

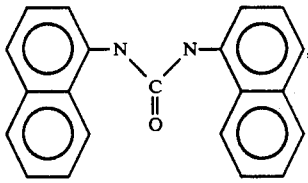 , and .

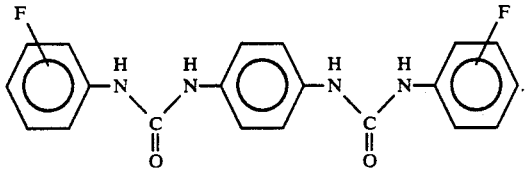

7. The developer according to claim 4, wherein said arylurea compound is internally added to the toner in a proportion of 0.1–10 wt. parts per 100 wt. parts of the binder resin.

8. The developer according to claim 4, wherein said arylurea compound is externally added to the toner in a proportion of 0.01–10 wt. parts per 100 wt. parts of the binder resin.

9. The developer according to claim 4, wherein said monocomponent-type developer comprises said toner and silica fine powder having BET specific surface area of at least 30 $m^2/g$.

10. The developer according to claim 9, wherein said silica fine powder comprises hydrophobic silica fine powder having a hydrophobicity of 30–80.

11. The developer according to claim 4, wherein said toner contains a colorant.

12. The developer according to claim 4, wherein said toner is a color toner containing a colorant.

13. The developer according to claim 4, wherein said toner is a magnetic toner containing a magnetic material having an average particle size of 0.1–1 micron.

14. The developer according to claim 13, wherein said magnetic material is contained in the magnetic toner in a proportion of 40–150 wt. parts per 100 wt. parts of the binder resin.

15. The developer according to claim 4, wherein said binder resin comprises a styrene-acrylate copolymer.

16. The developer according to claim 4, wherein said binder resin comprises a styrene-methacrylate copolymer.

17. The developer according to claim 4, wherein said binder resin comprises a polyester resin.

18. The developer according to claim 4, wherein microns.

19. The developer according to claim 4, wherein said toner has a weight-average particle size of 4–10 microns and contains 12–60% by number of toner particles having a particle size of 5 microns or smaller, 1–33% by number of toner particles having a particle size of 8–12.7 microns, and 2.0 wt. % or less of toner particles having a particle size of 16 microns or larger.

20. The developer according to claim 4, wherein said monocomponent-type developer contains at least one additive selected from the group consisting of lubricants, abrasives, fluidity-imparting agents, anti-caking agents, and electroconductivity-imparting agents.

21. The developer according to claim 4, wherein said toner contains a waxy substance.

22. The developer according to claim 2, which is a two-component-type developer comprising the toner and a carrier.

23. The developer according to claim 22, wherein said arylurea comprises an N,N'-bisarylurea derivative represented by the following formula:

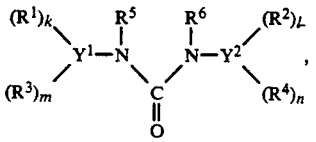

wherein $Y^1$ and $Y^2$ denote a phenyl or naphthyl group; $R^1$ and $R^2$ independently denote a halogen atom, nitro group, sulfonic acid group, carboxyl group, carboxylic acid ester group, cyano group or carbonyl group; $R^3$ and $R^4$ denote a hydrogen atom, alkyl group, alkoxy group, phenyl group capable of having a substituent, or aralkyl group capable of having a substituent; $R^5$ and $R^6$ denote a hydrogen atom or $C_1$–$C_8$ hydrocarbon group; k and l are 0, 1 or 2 satisfying $k+l \geqq 1$; and m and n are 1 or 2.

24. The developer according to claim 22, wherein said arylurea compound comprises at least one compound selected from the group consisting of:

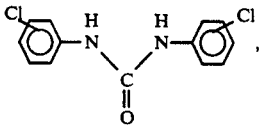

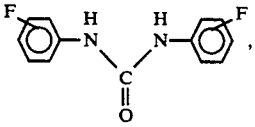

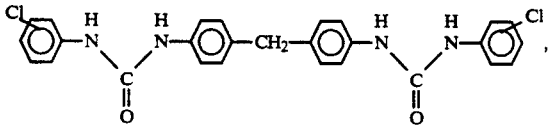

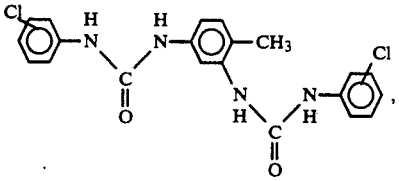

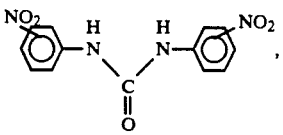

-continued

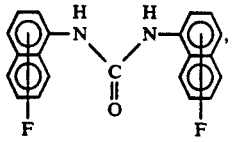

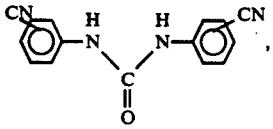

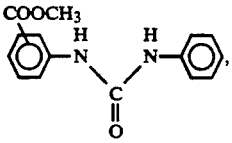

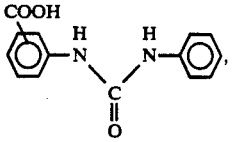

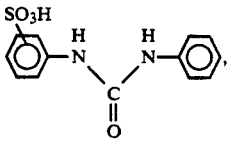

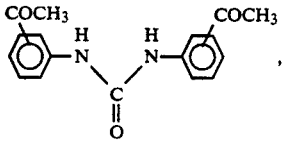

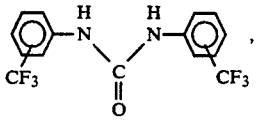

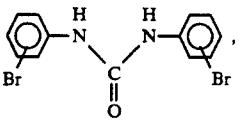

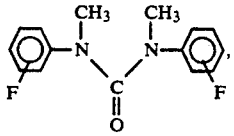

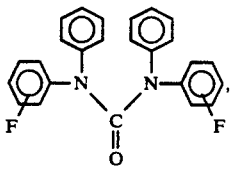

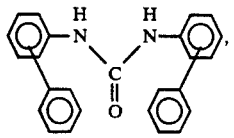

-continued

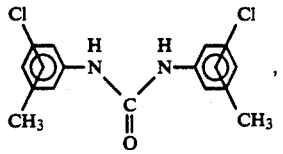

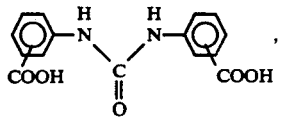

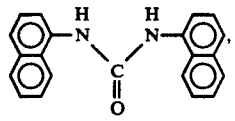

and

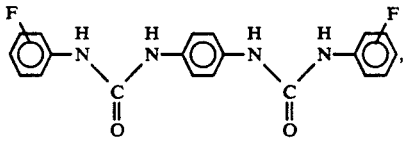

25. The developer according to claim 22, wherein said arylurea compound is internally added to the toner in a proportion of 0.1–10 wt. parts per 100 wt. parts of the binder resin.

26. The developer according to claim 22, wherein said arylurea compound is externally added to the toner in a proportion of 0.01–10 wt. parts per 100 wt. parts of the binder resin.

27. The developer according to claim 22, wherein said monocomponent-type developer comprises said toner and silica fine powder having BET specific surface area of at least 30 $m^2/g$.

28. The developer according to claim 27, wherein said silica fine powder comprises hydrophobic silica fine powder having a hydrophobicity of 30–80.

29. The developer according to claim 22, wherein said toner contains a colorant.

30. The developer according to claim 22, wherein said toner is a color toner containing a colorant.

31. The developer according to claim 22, wherein said toner is a magnetic toner containing a magnetic material having an average particle size of 0.1–1 micron.

32. The developer according to claim 31, wherein said magnetic material is contained in the magnetic toner in a proportion of 40–150 wt. parts per 100 wt. parts of the binder resin.

33. The developer according to claim 22, wherein said binder resin comprises a styrene-acrylate copolymer.

34. The developer according to claim 22, wherein said binder resin comprises a styrene-methacrylate copolymer.

35. The developer according to claim 22, wherein said binder resin comprises a polyester resin.

36. The developer according to claim 22, wherein said toner has a weight-average particle size of 3–15 microns.

37. The developer according to claim 22, wherein said toner has a weight-average particle size of 4–10 microns and contains 12–60% by number of toner particles having a particle size of 5 microns or smaller, 1–33% by number of toner particles having a particle size of 8–12.7 microns, and 2.0 wt. % or less of toner particles having a particle size of 16 microns or larger.

38. The developer according to claim 22, wherein said monocomponent-type developer contains at least one additive selected from the group consisting of lubricants, abrasives, fluidity-imparting agents, anti-caking agents, and electroconductivity-imparting agents.

39. The developer according to claim 22, wherein said toner contains a waxy substance.

40. The developer according to claim 1, wherein said arylurea has an electron-donating group.

41. The developer according to claim 40, wherein said arylurea comprises an N,N'-bisarylurea derivative represented by the following formula:

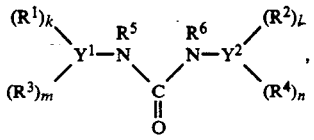

wherein $Y^1$ and $Y^2$ denote a phenyl group, naphthyl group or anthryl group; $R^1$ and $R^2$ independently denote an alkyl group, alkoxy group or amino group; $R^3$ and $R^4$ denote a hydrogen atom, alkyl group, alkoxy group, amino group, phenyl group capable of having a substituent, or aralkyl group capable of having a substituent; $R^5$ and $R^6$ are a hydrogen atom or $C_1$–$C_8$ hydrocarbon group; k and l are 0, 1 or 2 satisfying $k+l \geqq 1$; and m and n are 1 or 2.

42. The developer according to claim 40, which is a monocomponent-type developer comprising the toner.

43. The developer according to claim 42, wherein said arylurea comprises an N,N'-bisarylurea derivative represented by the following formula:

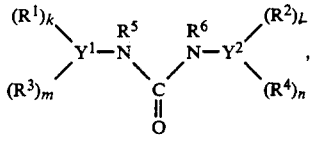

wherein $Y^1$ and $Y^2$ denote a phenyl group, naphthyl group or anthryl group; $R^1$ and $R^2$ independently denote an alkyl group, alkoxy group or amino group; $R^3$ and $R^4$ denote a hydrogen atom, alkyl group, alkoxy group, amino group, phenyl group capable of having a substituent, or aralkyl group capable of having a substituent; $R^5$ and $R^6$ are a hydrogen atom or $C_1$–$C_8$ hydrocarbon group; k and l are 0, 1 or 2 satisfying $k+l \geqq 1$; and m and n are 1 or 2.

44. The developer according to claim 42, wherein said arylurea compound comprises at least one compound selected from the group consisting of:

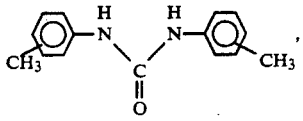

-continued

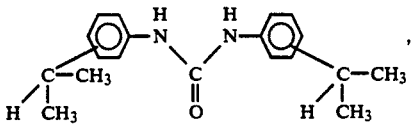

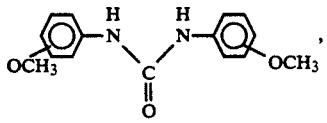

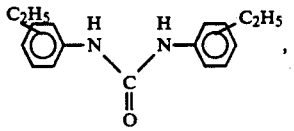

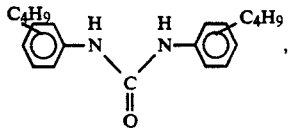

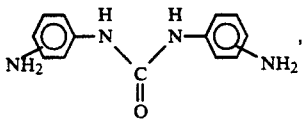

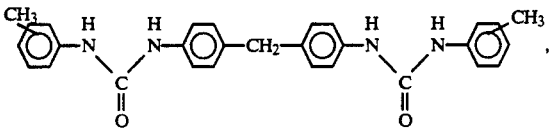

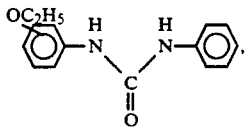

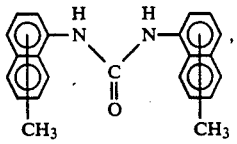

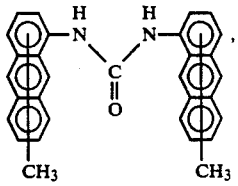

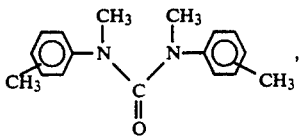

and

-continued

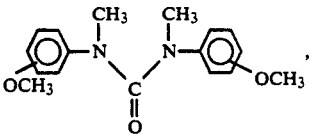

45. The developer according to claim 42, wherein said arylurea compound is internally added to the toner in a proportion of 0.1–10 wt. parts per 100 wt. parts of the binder resin.

46. The developer according to claim 42, wherein said arylurea compound is externally added to the toner in a proportion of 0.01–10 wt. parts per 100 wt. parts of the binder resin.

47. The developer according to claim 42, wherein said monocomponent-type developer comprises said toner and silica fine powder having BET specific surface area of at least 30 $m^2/g$.

48. The developer according to claim 47, wherein said silica fine powder comprises hydrophobic silica fine powder having a hydrophobicity of 30–80.

49. The developer according to claim 42, wherein said toner contains a colorant.

50. The developer according to claim 42, wherein said toner is a color toner containing a colorant.

51. The developer according to claim 42, wherein said toner is a magnetic toner containing a magnetic micron.

52. The developer according to claim 51, wherein said magnetic material is contained in the magnetic toner in a proportion of 40–150 wt. parts per 100 wt. parts of the binder resin.

53. The developer according to claim 42, wherein said binder resin comprises a styrene-acrylate copolymer.

54. The developer according to claim 42, wherein said binder resin comprises a styrene-methacrylate copolymer.

55. The developer according to claim 42, wherein said binder resin comprises a polyester resin.

56. The developer according to claim 42, wherein said toner has a weight-average particle size of 3–15 microns.

57. The developer according to claim 42, wherein said toner has a weight-average particle size of 4–10 microns and contains 12–60% by number of toner particles having a particle size of 5 microns or smaller, 1–33% by number of toner particles having a particle size of 8–12.7 microns, and 2.0 wt. % or less of toner particles having a particle size of 16 microns or larger.

58. The developer according to claim 42, wherein said monocomponent-type developer contains at least one additive selected from the group consisting of lubricants, abrasives, fluidity-imparting agents, anti-caking agents, and electroconductivity-imparting agents.

59. The developer according to claim 42, wherein said toner contains a waxy substance.

60. The developer according to claim 40, which is a monocomponent-type developer comprising the toner.

61. The developer according to claim 60, wherein said arylurea comprises an N,N'-bisarylurea derivative represented by the following formula:

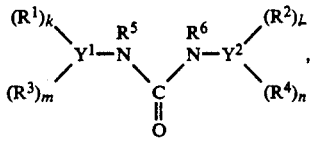

wherein $Y^1$ and $Y^2$ denote a phenyl group, naphthyl group or anthryl group; $R^1$ and $R^2$ independently denote an alkyl group, alkoxy group or amino group; $R^3$ and $R^4$ denote a hydrogen atom, alkyl group, alkoxy group, amino group, phenyl group capable of having a substituent, or aralkyl group capable of having a substituent; $R^5$ and $R^6$ are a hydrogen atom or $C_1$–$C_8$ hydrocarbon group; k and l are 0, 1 or 2 satisfying $k+l \geqq 1$; and m and n are 1 or 2.

62. The developer according to claim 60, wherein said arylurea compound comprises at least one compound selected from the group consisting of:

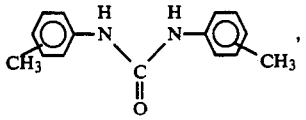

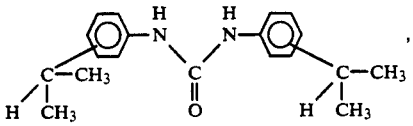

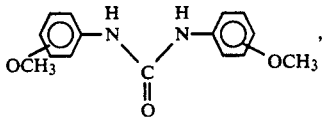

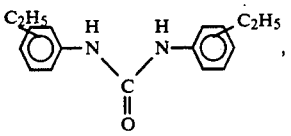

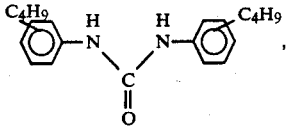

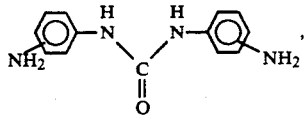

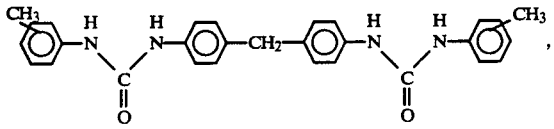

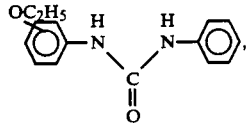

-continued

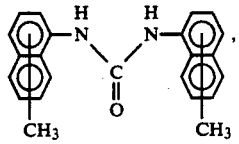

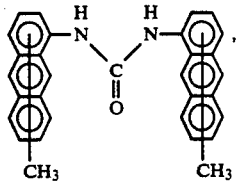

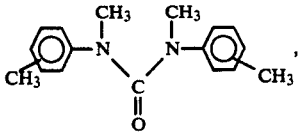

and

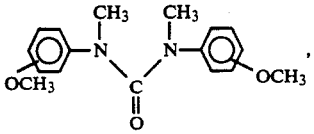

63. The developer according to claim 60, wherein said arylurea compound is internally added to the toner in a proportion of 0.1–10 wt. parts per 100 wt. parts of the binder resin.

64. The developer according to claim 60, wherein said arylurea compound is externally added to the toner in a proportion of 0.01–10 wt. parts per 100 wt. parts of the binder resin.

65. The developer according to claim 60, wherein said monocomponent-type developer comprises said toner and silica fine powder having BET specific surface area of at least 30 $m^2/g$.

66. The developer according to claim 65, wherein said silica fine powder comprises hydrophobic silica fine powder having a hydrophobicity of 30–80.

67. The developer according to claim 60, wherein said toner contains a colorant.

68. The developer according to claim 60, wherein said toner is a color toner containing a colorant.

69. The developer according to claim 60, wherein said toner is a magnetic toner containing a magnetic material having an average particle size of 0.1–1 micron.

70. The developer according to claim 69, wherein said magnetic material is contained in the magnetic toner in a proportion of 40–150 wt. parts per 100 wt. parts of the binder resin.

71. The developer according to claim 60, wherein said binder resin comprises a styrene-acrylate copolymer.

72. The developer according to claim 60, wherein said binder resin comprises a styrene-methacrylate copolymer.

73. The developer according to claim 60, wherein said binder resin comprises a polyester resin.

74. The developer according to claim 60, wherein said toner has a weight-average particle size of 3–15 microns.

75. The developer according to claim 60, wherein said toner has a weight-average particle size of 4–10 microns and contains 12–60% by number of toner particles having a particle size of 5 microns or smaller, 1–33% by number of toner particles having a particle size of 8–12.7 microns, and 2.0 wt. % or less of toner particles having a particle size of 16 microns or larger.

76. The developer according to claim 60, wherein said monocomponent-type developer contains at least one additive selected from the group consisting of lubricants, abrasives, fluidity-imparting agents, anti-caking agents, and electroconductivity-imparting agents.

77. The developer according to claim 70, wherein said toner contains a waxy substance.

* * * * *

UNITED STATES PATENT AND TRADEMARK OFFICE

CERTIFICATE OF CORRECTION

PATENT NO. : 5,288,579

DATED : February 22, 1994

INVENTOR(S) : KATSUHIKO TANAKA, ET AL.

It is certified that error appears in the above-indentified patent and that said Letters Patent is hereby corrected as shown below:

COLUMN 1

Line 61, "changes" should read --changes.--.

COLUMN 2

Line 59, "image-bearing" should read --image-bearing member--.

COLUMN 3

Line 26, "According" should read --According to--.
Line 39, "compound" should read --Compound--.

COLUMN 4

Line 67, "enumerated hereinbelow," should read --enumerated,--

COLUMN 7

Line 52, "electron-dona" should read --electron-donating--.
Line 53, "tive" should be deleted.
Line 54, "enumerated hereinbelow, should read --enumerated,--.

COLUMN 9

Line 45, "42 hours" should read --24 hours--.

UNITED STATES PATENT AND TRADEMARK OFFICE

CERTIFICATE OF CORRECTION

PATENT NO. :5,288,579

DATED :February 22, 1994

INVENTOR(S) :KATSUHIKO TANAKA, ET AL.

It is certified that error appears in the above-indentified patent and that said Letters Patent is hereby corrected as shown below:

COLUMN 10

Line 1, "form a" should read --form of--.
Line 2, "synthesized identified" should read --synthesized and identified--.
Line 58, "flame" should read --flame.--.

COLUMN 11

Line 36, "thylchlorsilane," should read --thylchlorosilane,--.

COLUMN 12

Line 35, "derivative" should read --derivatives--.

COLUMN 13

Line 10, "aluminum" should read --aluminum,--.
Line 11, "zinc," should be deleted.
Line 13, "mixture" should read --mixtures--.
Line 27, "2.0 wt." should read --2.0 wt. %--.
Line 29, "particle" should read --the particle--.
Line 41, "ISOTONR-II" should read --ISOTON$^{R}$-II--.

COLUMN 15

Line 33, "Gauss pole" should read --Gauss at a pole--.

COLUMN 16

Line 1, "n" should read --in--.

UNITED STATES PATENT AND TRADEMARK OFFICE

CERTIFICATE OF CORRECTION

PATENT NO. : 5,288,579

DATED : February 22, 1994

INVENTOR(S) : KATSUHIKO TANAKA, ET AL.

It is certified that error appears in the above-indentified patent and that said Letters Patent is hereby corrected as shown below:

COLUMN 17

Line 9, "a" should be deleted.
Line 54, "-28°C./g" should read -- -28 μC./g--.
Line 68, "$10^4$ sheets" should read --$10^4$ sheets.--.

COLUMN 20

Line 44, "$3\times10^4$ sheets" should read --$3\times10^4$ sheets.--.
Line 58, "a" should read --an--.

COLUMN 22

Line 22, "mono-component" should read --monocomponent--.
Line 49, "1 wt. parts" should read --1 wt. part--.

COLUMN 24

Line 18, "15°C./10RH," should read --15°C./10% RH,--.

COLUMN 26

Line 33, "a" should read --an--.
Line 53, "obtained" should read --obtained.--.

COLUMN 27

Line 67, "mono-compo-" should read --monocompo- --.

COLUMN 28

Line 16, "$2\times10^4$ sheets" should read --$2\times10^4$ sheets.--.
Line 26, "1 wt. parts" should read --1 wt. part--.

UNITED STATES PATENT AND TRADEMARK OFFICE

CERTIFICATE OF CORRECTION

PATENT NO. : 5,288,579

DATED : February 22, 1994

INVENTOR(S) : KATSUHIKO TANAKA, ET AL.

It is certified that error appears in the above-indentified patent and that said Letters Patent is hereby corrected as shown below:

COLUMN 34

Line 64, "wherein" should read --wherein said toner has a weight-average particle size of 3-15--.

COLUMN 40

Line 30, "magnetic" (second occurrence) should read --magnetic material having an average particle size of 0.1-1--.

Signed and Sealed this

Thirteenth Day of September, 1994

Bruce Lehman

*Attest:*

BRUCE LEHMAN

*Attesting Officer*

*Commissioner of Patents and Trademarks*